US009134684B2

(12) United States Patent
Sato

(10) Patent No.: US 9,134,684 B2
(45) Date of Patent: Sep. 15, 2015

(54) IMAGE FORMING DEVICE CAPABLE OF RELIABLY RECOVERING MATTER DEPOSITED ON ENDLESS BELT AND ENSURING SMOOTH OPERATIONS OF RETAINING MEMBER

(71) Applicant: Shougo Sato, Seto (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 121 days.

(21) Appl. No.: 13/960,207

(22) Filed: Aug. 6, 2013

(65) Prior Publication Data

US 2014/0037321 A1 Feb. 6, 2014

(30) Foreign Application Priority Data

Aug. 6, 2012 (JP) ..... 2012-173851

(51) Int. Cl.

| | |
|---|---|
| ***G03G 15/00*** | (2006.01) |
| ***G03G 21/00*** | (2006.01) |
| ***G03G 15/16*** | (2006.01) |
| ***G03G 21/10*** | (2006.01) |

(52) U.S. Cl.

CPC ..... *G03G 21/0005* (2013.01); *G03G 15/168* (2013.01); *G03G 21/105* (2013.01); *G03G 2215/0141* (2013.01); *G03G 2215/1661* (2013.01); *G03G 2221/1684* (2013.01)

(58) Field of Classification Search

CPC . G03G 15/168; G03G 21/105; G03G 21/169; G03G 21/1623; G03G 21/1671; G03G 15/161; G03G 15/095; G03G 2215/1661; G03G 2221/1642; G03G 2221/1654; G03G 2221/1684; G03G 2221/1884

See application file for complete search history.

(56) References Cited

U.S. PATENT DOCUMENTS

| | | | | |
|---|---|---|---|---|
| 2004/0052560 | A1* | 3/2004 | Ishii et al. | 399/360 |
| 2008/0166162 | A1* | 7/2008 | Hayashi et al. | 399/359 |
| 2009/0035014 | A1* | 2/2009 | Sato | 399/119 |
| 2009/0285593 | A1* | 11/2009 | Sakuma | 399/71 |
| 2010/0074646 | A1* | 3/2010 | Miyahara et al. | 399/99 |
| 2010/0209157 | A1* | 8/2010 | Sato et al. | 399/343 |
| 2010/0272467 | A1* | 10/2010 | Sato | 399/110 |
| 2011/0076056 | A1* | 3/2011 | Sato | 399/120 |
| 2012/0027459 | A1* | 2/2012 | Sato | 399/120 |

(Continued)

FOREIGN PATENT DOCUMENTS

| | | | |
|---|---|---|---|
| JP | 2010-008472 | A | 1/2010 |
| JP | 2010-191012 | A | 9/2010 |

*Primary Examiner* — G. M. Hyder

(74) *Attorney, Agent, or Firm* — Banner & Witcoff, Ltd.

(57) ABSTRACT

An image forming device includes: a main body; a photosensitive body; a retaining member; an endless belt; a first cleaning member; a belt side conveying unit; a retaining member side conveying unit; and a receptacle. The retaining member retains the photosensitive body and is movable between an internal position and an external position. The endless belt contacts the photosensitive body when the retaining member is in the internal position and separates from the photosensitive body when the retaining member is in the external position. The first cleaning member is fixedly positioned and removes deposited matter on the endless belt. The belt side conveying unit is provided in the main body and conveys the deposited matter removed by the first cleaning member. The retaining member side conveying unit is provided in the retaining member and conveys the deposited matter conveyed by the belt side conveying unit to the receptacle.

11 Claims, 14 Drawing Sheets

1

(56) References Cited

U.S. PATENT DOCUMENTS

2012/0213547 A1* 8/2012 Sato ..... 399/101
2012/0213566 A1* 8/2012 Sato ..... 399/358
2012/0213567 A1* 8/2012 Sato et al. ..... 399/358
2012/0251160 A1* 10/2012 Sato ..... 399/101

* cited by examiner

IMAGE FORMING DEVICE CAPABLE OF RELIABLY RECOVERING MATTER DEPOSITED ON ENDLESS BELT AND ENSURING SMOOTH OPERATIONS OF RETAINING MEMBER

CROSS REFERENCE TO RELATED APPLICATION

This application claims priority from Japanese Patent Application No. 2012-173851 filed Aug. 6, 2012. The entire content of this priority application is incorporated herein by reference.

TECHNICAL FIELD

The present invention relates to an image-forming device employing an electrophotographic system.

BACKGROUND

One electrophotographic image-forming device known in the art is a tandem-type color printer provided with a plurality of photosensitive drums corresponding to the plurality of colors (yellow, magenta, cyan, and black, for example) employed by the color printer. Some conventional tandem-type color printers are also provided with an endless conveying belt disposed in contact with all photosensitive drums, and a cleaning unit for cleaning the endless belt.

More specifically, one color laser printer that has been proposed includes a retaining member such as a process frame provided with four photosensitive drums corresponding to the four colors employed by the laser printer and, disposed within the process frame, a belt cleaner for cleaning a conveying belt, a waste toner collecting unit for collecting waste toner recovered by the belt cleaner, and conveying members (first and second screws and a lift) for conveying waste toner from the belt cleaner to the waste toner collecting unit.

Another image-forming device that has been proposed includes an image-forming unit supporting process cartridges corresponding to the colors employed by the image-forming device, and a belt unit having a sheet-conveying belt, the image-forming unit being provided with a waste toner collection box for collecting waste toner, and the belt unit provided with a belt cleaning device for cleaning the sheet-conveying belt, and a belt-waste-toner delivery tube for conveying waste toner collected by the belt cleaning device to the waste toner collection box.

With the color laser printer described above in the first example, the belt cleaner is separated from the conveying belt in order to remove the process frame from the main casing. However, when the belt cleaner is separated from the conveying belt, there is a chance that waste toner may drop from the belt cleaner.

Thus, efforts were made to prevent waste toner from dropping off the belt cleaning device by providing the belt unit with a belt cleaning device and a belt-waste-toner delivery tube, as in the image-forming device of the second example given above. However, in the image-forming device of the second example, the belt-waste-toner delivery tube projects into the main casing constituting the image-forming device, leading to the waste toner collection box. Consequently, the belt-waste-toner delivery tube may interfere with the image-forming unit when the image-forming unit is being mounted in the main casing.

SUMMARY

In view of the foregoing, it is an object of the present invention to provide an image-forming device capable of both reliably recovering matter deposited on an endless belt and ensuring smooth operations of a retaining member.

In order to attain the above and other objects, the present invention provides an image forming device comprising: a main body; a photosensitive body; a retaining member; an endless belt; a first cleaning member; a receptacle; and a conveying unit. A developer image is formable on the photosensitive body. The retaining member is configured to retain the photosensitive body and is movable between an internal position inside the main body and an external position outside the main body. The endless belt is configured to contact the photosensitive body when the retaining member is in the internal position and separate from the photosensitive body when the retaining member is in the external position. The first cleaning member is fixedly positioned and configured to remove deposited matter on the endless belt. The receptacle is configured to be detachably mounted in the retaining member and store the deposited matter removed by the first cleaning member. The conveying unit is configured to convey the deposited matter removed by the first cleaning member into the receptacle. The conveying unit includes: a belt side conveying unit; and a retaining member side conveying unit. The belt side conveying unit is provided in the main body and configured to convey the deposited matter removed by the first cleaning member. The retaining member side conveying unit is provided in the retaining member and configured to convey the deposited matter conveyed by the belt side conveying unit.

BRIEF DESCRIPTION OF THE DRAWINGS

The particular features and advantages of the invention as well as other objects will become apparent from the following description taken in connection with the accompanying drawings, in which:

FIGS. 3A and 3B are cross-sectional views of the transfer unit shown in FIG. 2; and in which FIG. 3A shows a cross-sectional view along a line A-A in FIG. 2; and FIG. 3B shows a cross-sectional view along a line B-B in FIG. 2;

FIGS. 4A and 4B are cross-sectional views of the transfer unit along a line C-C in FIG. 2; and in which FIG. 4A shows a state where a first conveying unit is disposed in a coupled position, and FIG. 4B shows a state where the first conveying unit is disposed in an uncoupled position;

DETAILED DESCRIPTION

Figure 1:
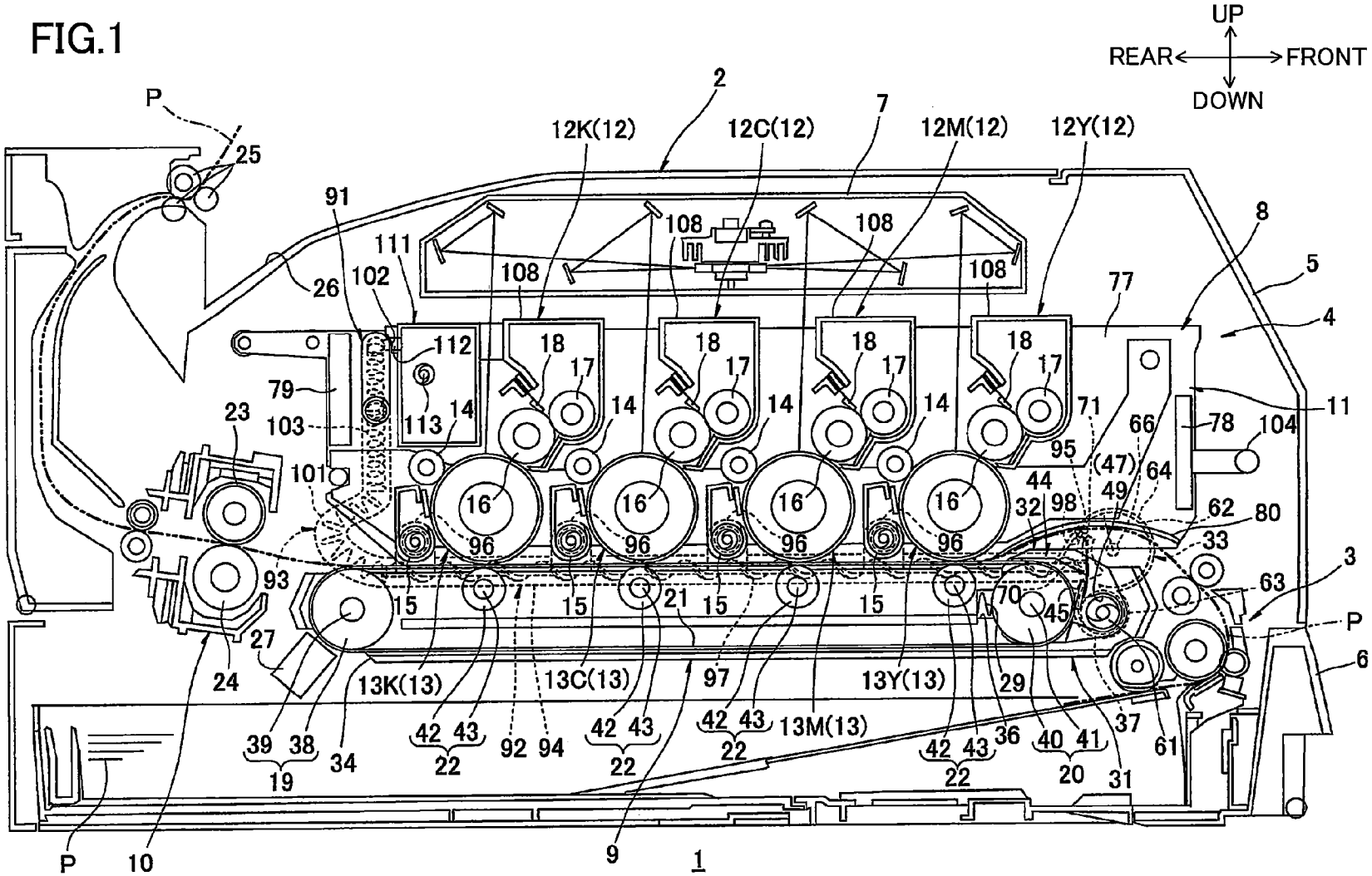
FIG. 1 is a vertical cross-sectional view of an image-forming device according to a first embodiment of the present invention.

An Image-forming device according to embodiments of the present invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the image-forming device is disposed in an orientation in which it is intended to be used. In use, the image-forming device is disposed as shown in FIG. 1.

1. Overall Structure of a Printer

FIG. 1 shows a printer 1 serving as an example of the image-forming device according to the present invention. The printer 1 is a direct horizontal tandem-type color laser printer.

The printer 1 includes a main casing 2 constituting the device body. The main casing 2 is formed in a box-like shape that is generally rectangular in a side view. A front cover 5 is provided on one side of the main casing 2 for mounting and removing a process unit 8 described later.

Descriptions used in the following description in relation to the printer 1 will reference the state of the printer 1 when the printer 1 is resting on a flat surface. More specifically, the side of the printer 1 on which the front cover 5 is provided (the right side in FIG. 1) will be referred to as the "front side," and the opposite side (the left side in FIG. 1) as the "rear side," as indicated by the arrows in FIG. 1. Further, left and right sides of the printer 1 in the following description will be based on the perspective of the user facing the front side of the printer 1. Thus, the near side of the printer 1 in FIG. 1 will be considered the "left side," and the far side will be considered the "right side."

Within the main casing 2, the printer 1 also includes a sheet-feeding unit 3 for feeding sheets P of paper to be printed, and an image-forming unit 4 for forming images on the sheets P supplied by the sheet-feeding unit 3.

(1) Sheet-Feeding Unit

The sheet-feeding unit 3 is disposed in the bottom section of the main casing 2 and includes a paper tray 6 accommodating sheets P of paper, and a plurality of rollers for conveying the sheets P to the image-forming unit 4.

(2) Image-Forming Unit

The image-forming unit 4 includes a scanning unit 7, a process unit 8, a transfer unit 9, and a fixing unit 10.

(2-1) Scanning Unit

The scanning unit 7 is disposed in the top section of the main casing 2. The scanning unit 7 emits four laser beams toward respective photosensitive drums 13 (described later), the paths of which are depicted by solid lines in FIG. 1, thereby exposing the photosensitive drums 13.

(2-2) Process Unit

The process unit 8 is disposed beneath the scanning unit 7 and above the transfer unit 9. The process unit 8 includes four developer cartridges 12 corresponding to the four colors used in image formation, and a process frame 11 for retaining the developer cartridges 12.

Figure 9:
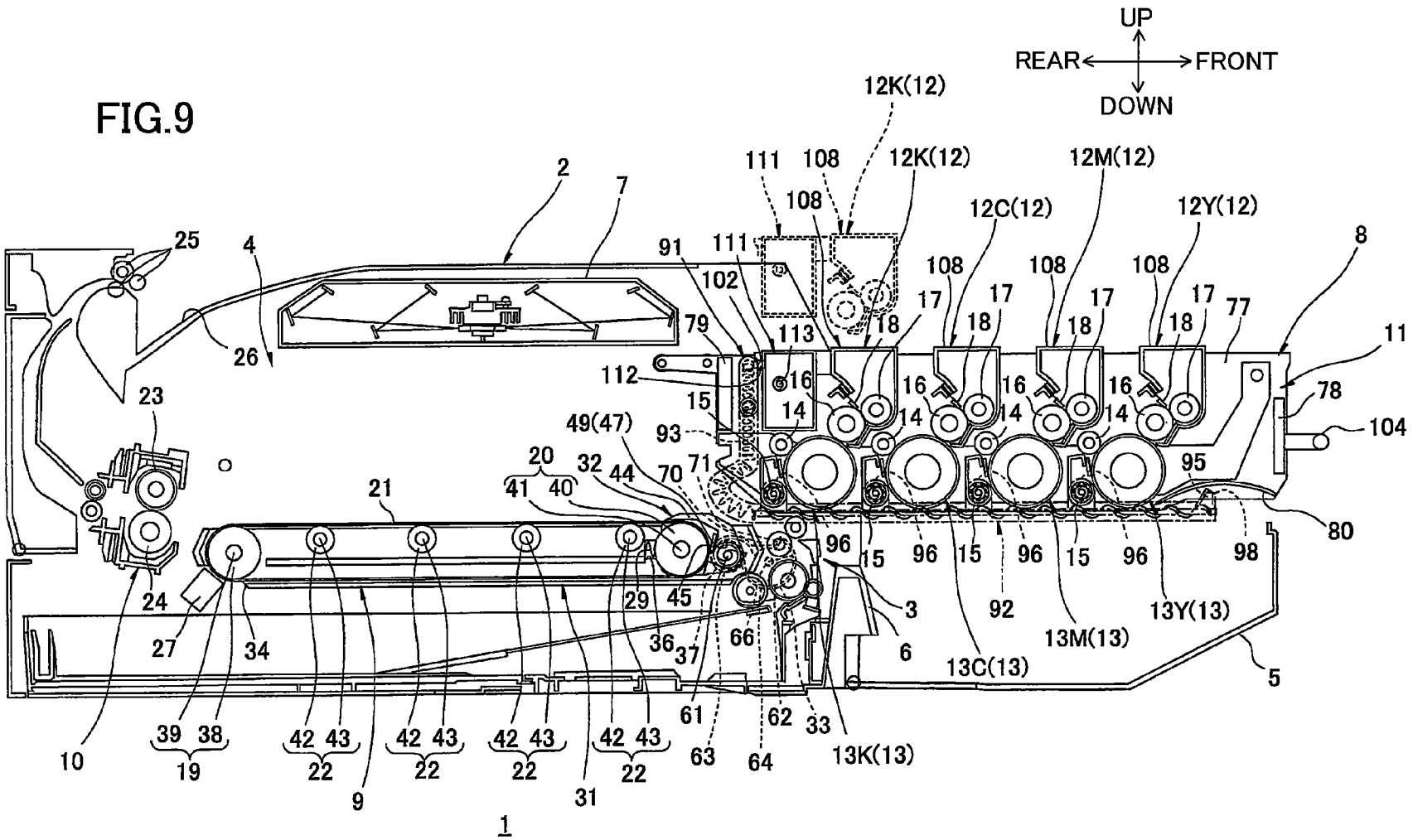
FIG. 9 is an explanatory diagram showing a state where the process unit shown in FIG. 1 is disposed in an external position.

The process frame 11 can move relative to the main casing 2 in the front-rear direction between an internal position (see FIG. 1) and an external position (see FIG. 9). In the internal position, the process frame 11 is accommodated inside the main casing 2. In the external position, the process frame 11 is withdrawn to the outside of the main casing 2. The process frame 11 retains four each of photosensitive drums 13, charging rollers 14, and drum cleaning units 15.

The four photosensitive drums 13 corresponding to the four printing colors are arranged parallel to one another and spaced at intervals in the front-rear direction. Specifically, the photosensitive drums 13 include a yellow photosensitive drum 13Y, a magenta photosensitive drum 13M, a cyan photosensitive drum 13C, and a black photosensitive drum 13K arranged in the order given from the front side toward the rear side. The photosensitive drums 13 are generally cylindrical in shape and are oriented with their axes aligned in the left-right direction (longitudinal direction).

The charging rollers 14 are disposed on the upper rear side of corresponding photosensitive drums 13, contacting the upper rear sides of the photosensitive drums 13 with pressure. The charging rollers 14 are generally cylindrical in shape with their axes aligned in the left-right direction.

The drum cleaning units 15 are disposed on the rear sides of the corresponding photosensitive drums 13 and below the corresponding charging rollers 14. The drum cleaning units 15 contact the photosensitive drums 13 from the rear sides thereof and function to clean the surfaces of the photosensitive drums 13, as will be described later in greater detail.

The four developer cartridges 12 are provided to correspond with the four photosensitive drums 13 and are arranged parallel to one another and spaced apart at intervals in the front-rear direction. Specifically, the developer cartridges 12 include a yellow developer cartridge 12Y, a magenta developer cartridge 12M, a cyan developer cartridge 12C, and a black developer cartridge 12K arranged in the order given from front to rear. The developer cartridges 12 are formed in a box-like shape elongated in the left-right direction and are detachably mounted in the process frame 11 so as to be positioned on the upper front side of the corresponding photosensitive drums 13.

Each developer cartridge 12 includes a developing roller 16. The developing roller 16 is rotatably supported in the lower portion of the developer cartridge 12. The developing roller 16 is exposed in the rear side of the developer cartridge 12 and contacts the upper front side of the corresponding photosensitive drum 13.

Each developer cartridge 12 also includes a supply roller 17 that contacts the upper front side of the corresponding developing roller 16, and a thickness-regulating blade 18 that contacts the top of the corresponding developing roller 16. Each developer cartridge 12 has space formed above the supply roller 17 and thickness-regulating blade 18 for accommodating toner.

(2-3) Transfer Unit

The transfer unit 9 is disposed in the main casing 2 at a position above the sheet-feeding unit 3 and beneath the process unit 8. The transfer unit 9 includes a drive roller 19, a follow roller 20, an endless conveying belt 21, and four transfer rollers 22.

The drive roller 19 and follow roller 20 are arranged parallel to each other and are separated in the front-rear direction.

The endless conveying belt 21 is looped around the drive roller 19 and follow roller 20, with the upper portion of the endless conveying belt 21 in contact with the bottom sides of the photosensitive drums 13. In other words, the photosensitive drums 13 contact the endless conveying belt 21 from above. When the drive roller 19 is driven to rotate, the endless conveying belt 21 circulates so that its upper portion moves rearward, and the follow roller 20 rotates along with the circulating movement of the endless conveying belt 21.

Each of the transfer rollers 22 is disposed in confrontation with a corresponding photosensitive drum 13, with the upper portion of the endless conveying belt 21 interposed between the top of each transfer roller 22 and the bottom of the corresponding photosensitive drum 13.

A patch sensor 27 is also provided in the main casing 2 on the lower rear side of the drive roller 19.

(2-4) Fixing Unit

The fixing unit 10 is disposed on the rear side of the transfer unit 9. The fixing unit 10 includes a heating roller 23, and a pressure roller 24 that contacts and applies pressure to the bottom side of the heating roller 23.

(3) Image-Forming Operation

Toner in each of the developer cartridges 12 is supplied onto the corresponding supply roller 17, and the supply roller 17 in turn supplies the toner onto the corresponding developing roller 16 while the toner is tribocharged between the supply roller 17 and developing roller 16. The thickness-regulating blade 18 regulates the thickness of toner supplied to the developing roller 16 as the developing roller 16 rotates, maintaining the toner carried on the surface of the developing roller 16 at a thin uniform thickness.

In the meantime, the charging roller 14 applies a uniform charge to the surface of the corresponding photosensitive drum 13. Subsequently, the photosensitive drum 13 is exposed by the scanning unit 7, forming an electrostatic latent image on the surface of the photosensitive drum 13 based on image data. The toner carried on the developing roller 16 is then supplied to the latent image formed on the photosensitive drum 13 to produce a toner image thereon.

The various rollers constituting the sheet-feeding unit 3 rotate to convey a sheet P from the paper tray 6 along a U-shaped path that changes the conveying direction from a forward direction to a diagonally rearward and upward direction. The rollers supply one sheet P at a time toward the image-forming unit 4 (between the photosensitive drums 13 and the endless conveying belt 21) at a prescribed timing. The endless conveying belt 21 subsequently conveys the sheet P rearward so that the sheet P passes sequentially between the photosensitive drums 13 and corresponding transfer rollers 22. At this time, toner images carried on the photosensitive drums 13 are transferred to the sheet P to form an image thereon.

Next, the sheet P is subjected to heat and pressure while passing between the heating roller 23 and pressure roller 24 of the fixing unit 10, thereby fixing the image to the sheet P. Subsequently, the sheet P is conveyed along a U-shaped path that changes the conveying direction from a rearward direction to a direction diagonally upward and forward. Discharge rollers 25 disposed at the top of the conveying path discharge the sheet P onto a discharge tray 26 formed on the top surface of the main casing 2.

2. Detailed Structure of the Transfer Unit

Figure 2:
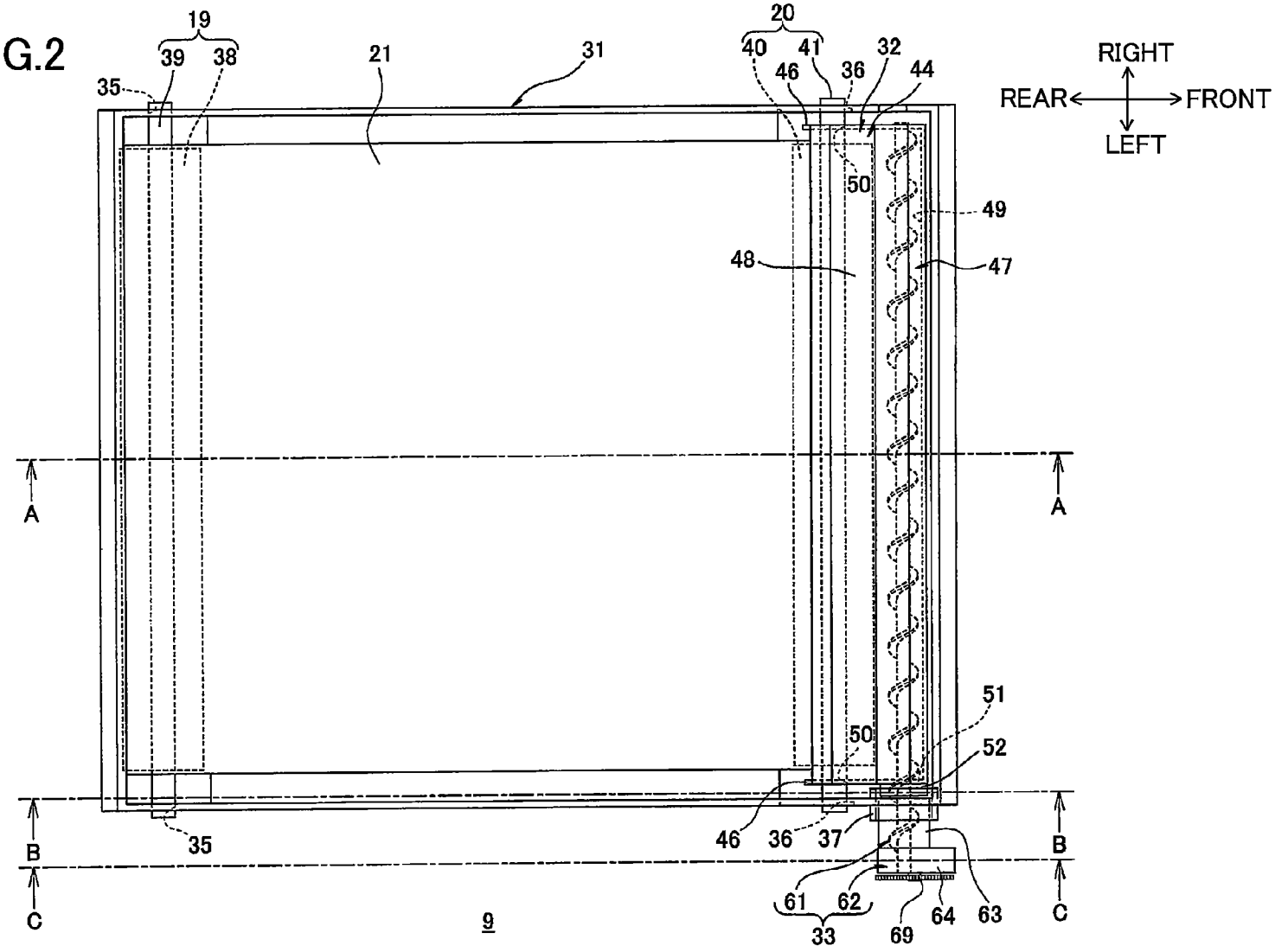
FIG. 2 is a plan view of a transfer unit shown in FIG. 1.

As shown in FIGS. 2 and 3, the transfer unit 9 is provided with a transfer frame 31, a belt cleaner 32, and a first conveying unit 33.

(1) Transfer Frame

The exposure opening 34 is formed in the bottom portion of the transfer frame 31 at the rear end thereof and extends across the entire left-right dimension of the transfer frame 31. The exposure opening 34 is formed in an area confronting the patch sensor 27 provided in the main casing 2 (see FIG. 1).

As shown in FIGS. 2 and 4, the transfer frame 31 has a frame-like structure with a closed bottom and is generally rectangular in a plan view. The transfer frame 31 includes an exposure opening 34, drive-roller-shaft insertion holes 35, follow-roller-shaft insertion openings 36, and a support part 37.

The drive-roller-shaft insertion holes 35 are generally circular in a side view and formed in the rear end of the transfer frame 31, with one drive-roller-shaft insertion hole 35 penetrating each of the left and right side walls thereof. The drive-roller-shaft insertion holes 35 have a diameter approximately equivalent to (slightly larger than) the major diameter of a drive roller shaft 39 described later.

The follow-roller-shaft insertion openings 36 have a general rectangular shape in a side view that is elongated in the front-rear direction, and penetrate the left and right side walls of the transfer frame 31 near the front ends thereof. The follow-roller-shaft insertion openings 36 have a vertical dimension that is approximately equivalent to (slightly larger than) the major diameter of a follow roller shaft 41 described later. A compression spring 29 is provided inside each of the follow-roller-shaft insertion openings 36. The compression spring 29 is a compression coil spring that extends in the front-rear direction. The rear end of the compression spring 29 is anchored to the inner surface on the rear side of the corresponding follow-roller-shaft insertion opening 36.

The support part 37 is provided on the left wall of the transfer frame 31 near the front end thereof and is positioned forward of the follow-roller-shaft insertion opening 36. The support part 37 is generally cylindrical in shape and elongated in the left-right direction so as to penetrate the left wall of the transfer frame 31. The support part is provided with a support-part-side sealing member 30 (see FIG. 5).

Figure 5:
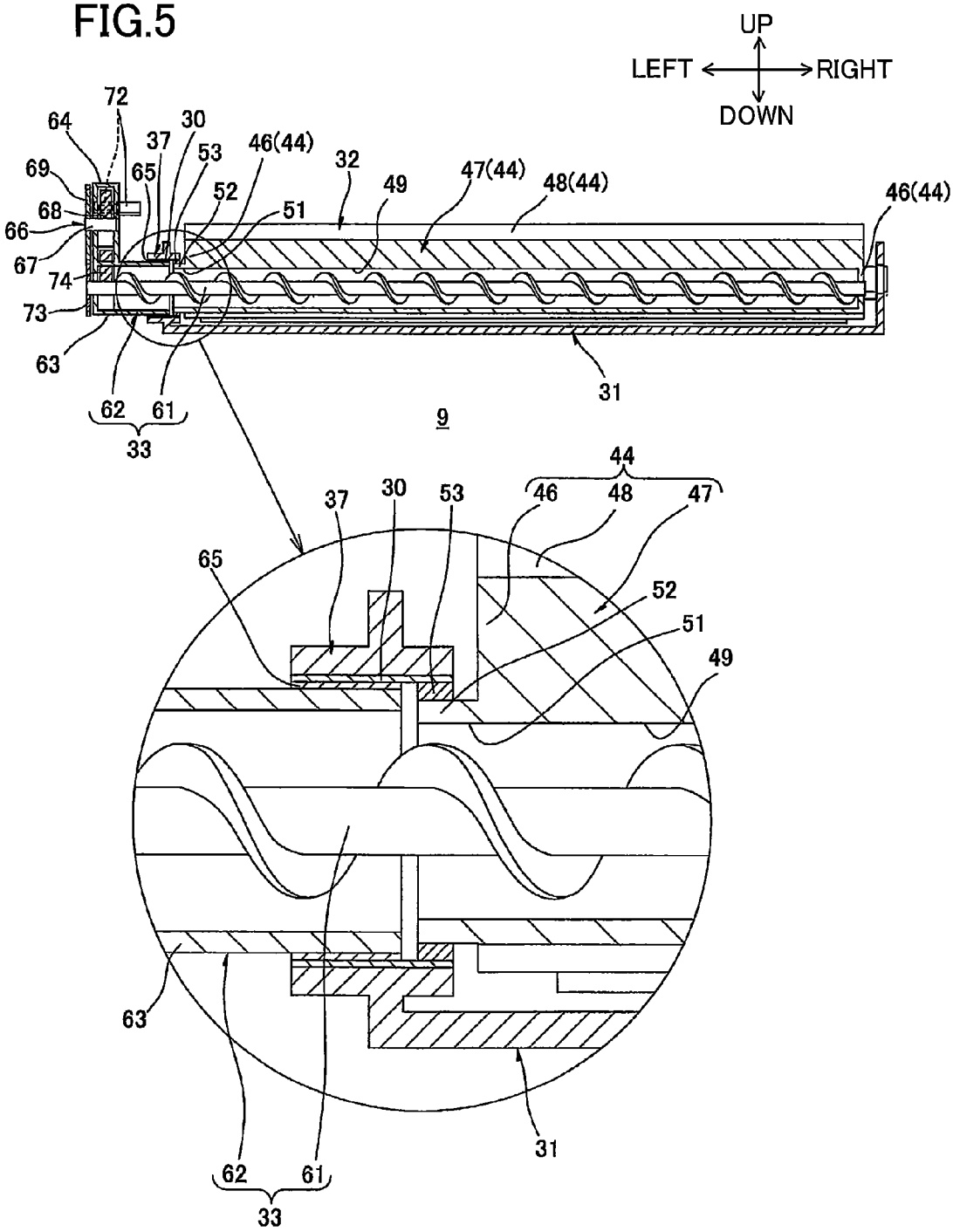
FIG. 5 is a cross-sectional view of the transfer unit along a D-D line in FIG. 4A.

As shown in FIG. 5, the support-part-side sealing member 30 is affixed to the inner peripheral surface of the support part 37 so as to cover the entire inner peripheral surface thereof. The support-part-side sealing member 30 is formed of an elastic material such as a sponge or nonwoven fabric.

As shown in FIGS. 2 and 3, the transfer frame 31 supports the drive roller 19, the follow roller 20, the four transfer rollers 22, and the endless conveying belt 21.

The drive roller 19 includes a drive roller body 38, and a drive roller shaft 39.

The drive roller body 38 has a generally cylindrical shape that is elongated in the left-right direction and is retained in the transfer frame 31 so that its top peripheral portion is positioned above the top of the transfer frame 31. The lower rear peripheral portion of the drive roller body 38 is exposed in the lower rear portion of the transfer frame 31 through the exposure opening 34. The left-right length of the drive roller body 38 is slightly shorter than the left-right dimension of the endless conveying belt 21.

The drive roller shaft 39 is inserted through the drive roller body 38 such that the left and right ends of the drive roller shaft 39 are exposed on the outside of the drive roller body 38. The drive roller shaft 39 is generally rod-shaped, with its longitudinal dimension aligned with the central axis of the drive roller body 38. The left-right length of the drive roller shaft 39 is greater than the left-right dimension of the endless conveying belt 21. Both left and right ends of the drive roller shaft 39 are fixed to the drive roller body 38 by flange members (not shown) so that the drive roller shaft 39 cannot rotate relative to the drive roller body 38. The left and right ends of the drive roller shaft 39 are rotatably inserted into the corresponding drive-roller-shaft insertion holes 35 formed in the left and right sides of the transfer frame 31 (see FIG. 4A).

The follow roller 20 includes a follow roller body 40, and a follow roller shaft 41.

The follow roller body 40 is generally cylindrical in shape and elongated in the left-right direction. The follow roller body 40 has the same diameter as the drive roller body 38 and is retained in the transfer frame 31 such that its top peripheral portion is disposed at approximately the same vertical position as the top peripheral portion of the drive roller body 38. The left-right length of the follow roller body 40 is slightly shorter than the left-right dimension of the endless conveying belt 21.

The follow roller shaft 41 is inserted through the follow roller body 40 such that both left and right ends are exposed on the outside thereof. The follow roller shaft 41 is generally rod-shaped, with its longitudinal dimension oriented along the central axis of the follow roller body 40. The left-right length of the follow roller shaft 41 is greater than the left-right dimension of the endless conveying belt 21. Both left and right ends of the follow roller shaft 41 are fixed to the left and right ends of the follow roller body 40 with flange members (not shown) so that the follow roller shaft 41 is incapable of rotating relative to the follow roller body 40. The left and right ends of the follow roller shaft 41 are inserted into the corresponding follow-roller-shaft insertion openings 36 formed in the left and right sides of the transfer frame 31 and are capable of both rotating and moving forward and rearward within the follow-roller-shaft insertion openings 36 (see FIG. 4A).

Figure 4A:
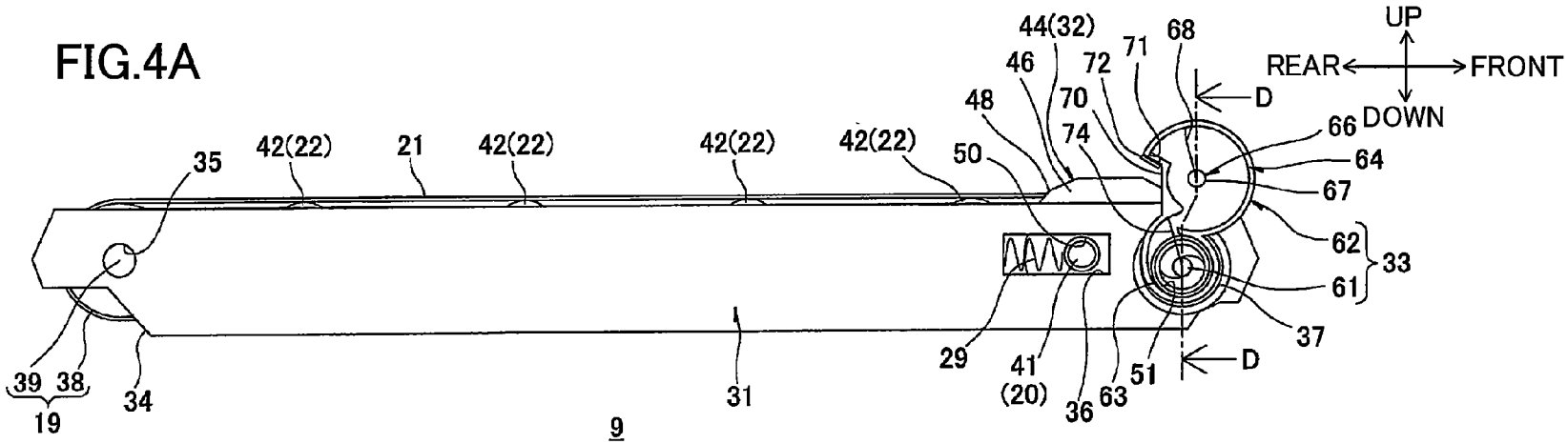
Figure 4B:
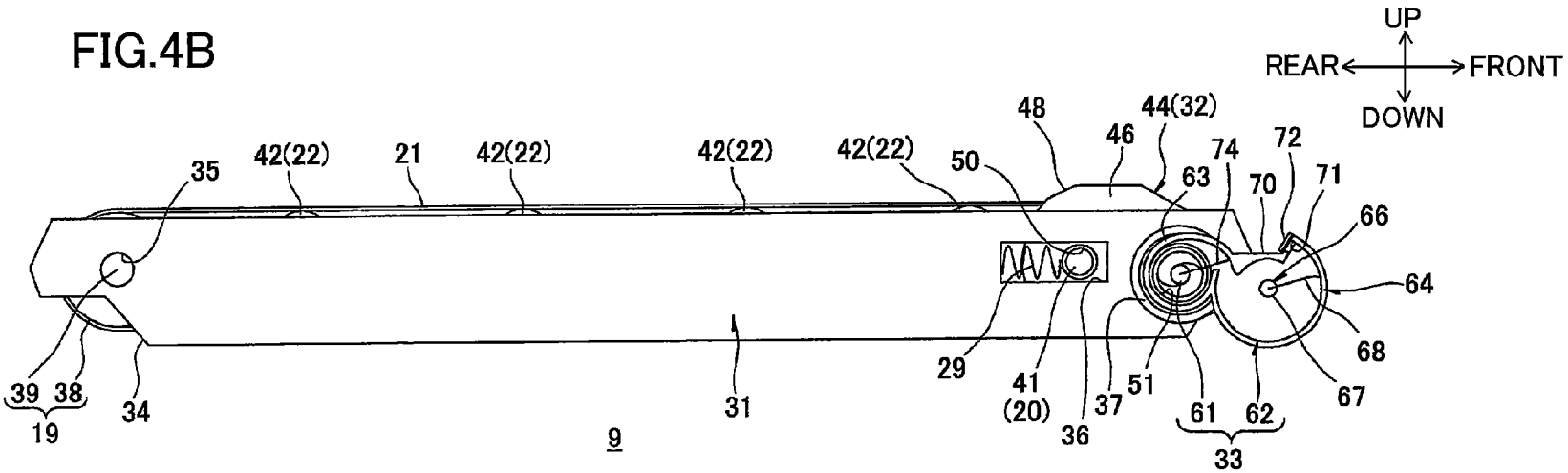

Further, the left and right ends of the follow roller shaft 41 contact the front ends of the compression springs 29 in the corresponding follow-roller-shaft insertion openings 36 from the front sides thereof (see FIG. 4A). Thus, the elastic force of the compression springs 29 constantly urges the follow roller 20 forward.

Each of the transfer rollers 22 is configured of a transfer roller body 42, and a transfer roller shaft 43.

The transfer roller body 42 is generally cylindrical in shape and elongated in the left-right direction. The transfer roller body 42 is formed of an electrically conductive resin material and has a smaller outer diameter than the outer diameters of the drive roller body 38 and follow roller body 40. The transfer rollers 22 are retained in the transfer frame 31 so that the top peripheral portions of the transfer roller bodies 42 are at substantially the same vertical position as the top peripheral portion of the drive roller body 38.

The transfer roller shaft 43 is formed of a metal in a general rod shape whose longitudinal dimension is oriented along the central axis of the transfer roller body 42.

The endless conveying belt 21 is formed of an electrically conductive resin material. The endless conveying belt 21 is a wide belt formed in a continuous loop having sufficient length to be placed around the drive roller 19 and follow roller 20.

(2) Belt Cleaner

The belt cleaner 32 is disposed inside the front end of the transfer frame 31. The belt cleaner 32 includes a cleaner frame 44, and a cleaning blade 45.

The cleaner frame 44 is formed in a generally cylindrical shape that is closed on both left and right ends and open on the lower rear side. More specifically, the cleaner frame 44 is integrally provided with a pair of left and right side walls 46, a main body 47, and a top wall 48.

Figure 3A:
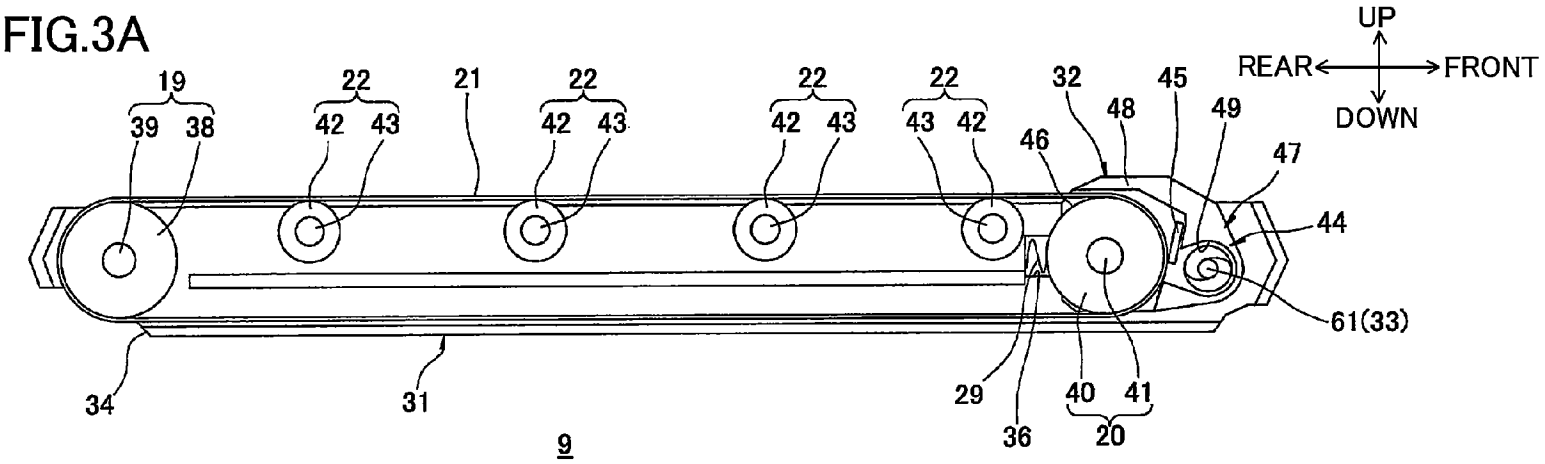
Figure 3B:
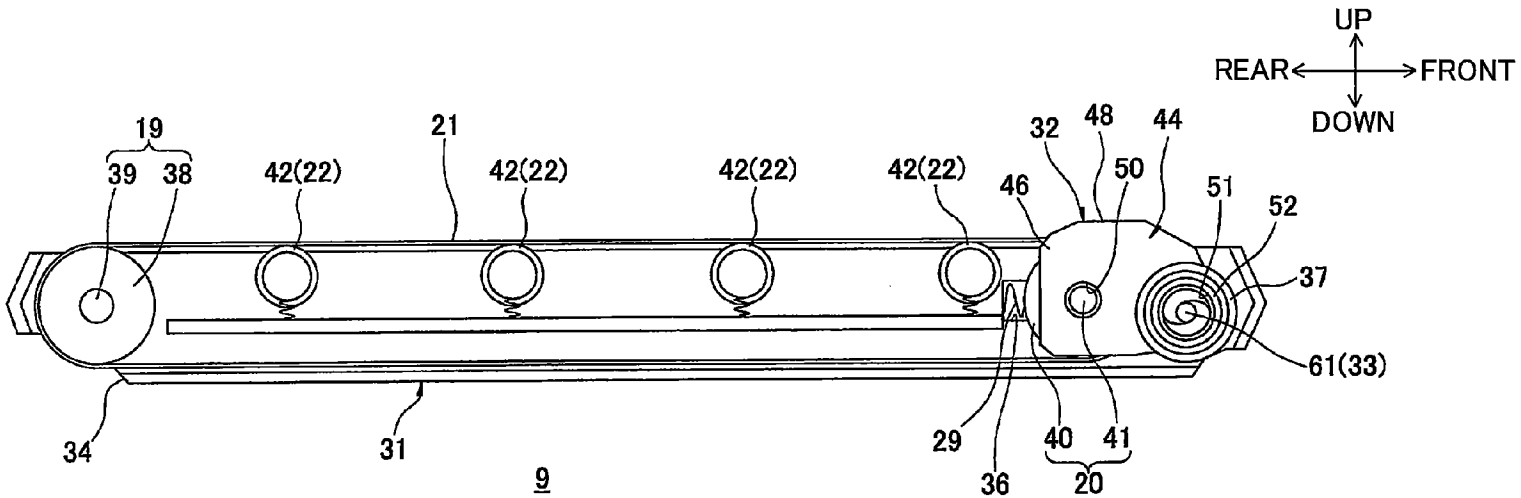

The side walls 46 have a flat plate shape and are generally rectangular in a side view. The side walls 46 are arranged parallel to each other and are spaced apart in the left-right direction, with the gap between side walls 46 in the left-right direction being greater than the left-right length of the follow roller body 40 and shorter than the gap between the left and right side walls of the transfer frame 31. As shown in FIG. 3B, follow-roller-shaft insertion holes 50 are formed one in each of the side walls 46.

The follow-roller-shaft insertion holes 50 are generally circular in a side view and penetrate the side walls 46 near the rear ends thereof. The follow-roller-shaft insertion holes 50 have a diameter that is approximately equivalent to (slightly greater than) the outer diameter of the follow roller shaft 41.

As shown in FIG. 3B, the left side wall 46 is provided with a screw insertion hole 51, and a cleaner-side supported part 52.

The screw insertion hole 51 has a generally circular shape in a side view and is formed near the front end of the side wall 46. The screw insertion hole 51 has a diameter that is slightly larger than the major diameter of a first screw 61 (described later) constituting the first conveying unit 33.

The cleaner-side supported part 52 is generally cylindrical in shape and extends leftward from the peripheral edge portion of the screw insertion hole 51. The cleaner-side supported part 52 has a smaller outer diameter than the inner diameter of the support part 37 constituting the transfer frame 31. The cleaner-side supported part 52 includes a cleaner-side sealing member 53 (see FIG. 5).

The cleaner-side sealing member 53 is affixed to the outer peripheral surface of the cleaner-side supported part 52 so as to cover the entire outer peripheral surface thereof. The cleaner-side sealing member 53 is formed of an elastic material, such as a sponge or nonwoven cloth.

The main body 47 bridges the front ends of the side walls 46. The main body 47 has a general columnar shape elongated in the left-right direction, with a generally D-shaped cross section curved on the front side thereof. A recovery chamber 49 is formed inside the main body 47.

The recovery chamber 49 is a recessed groove formed in the rear side of the main body 47 and is elongated in the left-right direction. A cross section of the recovery chamber 49 is generally U-shaped and open on the rear side. The recovery chamber 49 spans across the entire left-right dimension of the main body 47.

The top wall 48 has a generally flat plate shape that extends rearward from the top edge of the main body 47. The rear edge of the top wall 48 extends to a position farther rearward than the follow roller shaft 41 and forward of the forwardmost transfer roller 22 in a vertical projection.

The cleaning blade 45 is provided on the rear edge constituting the top portion of the main body 47. The cleaning blade 45 is generally plate-shaped and elongated in the left-right direction with substantial thickness in the front-rear direction. The upper half of the cleaning blade 45 is fixed to the portion of the main body 47 forming the top peripheral edge of the recovery chamber 49. The lower half of the cleaning blade 45 confronts the upper half of the recovery chamber 49.

The belt cleaner 32 is coupled to the follow roller 20 by inserting both left and right ends of the follow roller shaft 41 into the follow-roller-shaft insertion holes 50 formed in the side walls 46. The bottom edge of the cleaning blade 45 confronts the front side of the follow roller 20 with the endless conveying belt 21 interposed therebetween and, hence, contacts the front side of the endless conveying belt 21 looped around the follow roller 20. With this construction, the cleaning blade 45 is fixed in position relative to the endless conveying belt 21.

As shown in FIGS. 2 and 5, the belt cleaner 32 is supported in the transfer frame 31 by fitting the cleaner-side supported part 52 into the support part 37 formed in the transfer frame 31 from the right side thereof. At this time, the cleaner-side sealing member 53 contacts the right end portion of the support-part-side sealing member 30 in the transfer frame 31 (see the enlarged view in FIG. 5). The cleaner-side sealing member 53 can also be compressed in its thickness direction (i.e., the radial direction of the cleaner-side supported part 52). As a result, the belt cleaner 32 can move relative to the transfer frame 31 in the front-rear direction a distance equivalent to the compressible amount of the cleaner-side sealing member 53.

(3) First Conveying Unit

As shown in FIGS. 4 and 5, the first conveying unit 33 includes a lift 62, and a first screw 61.

The lift 62 is rotatably supported in the support part 37 of the transfer frame 31. The lift 62 includes a lift-side supported part 63, and an intermediary conveying part 64. In the following description of the lift 62, it will be assumed that the lift 62 is disposed in a coupled position described later (see FIG. 4A).

The lift-side supported part 63 is generally cylindrical in shape, with a closed left end, and is elongated in the left-right direction. The outer diameter of the lift-side supported part 63 is smaller than the inner diameter of the support part 37 constituting the transfer frame 31 and larger than the outer diameter of the cleaner-side supported part 52. The lift-side supported part 63 includes a lift-side sealing member 65.

The lift-side sealing member 65 is affixed to the outer peripheral surface of the lift-side supported part 63 on the right end thereof and covers the entire peripheral surface of this right end portion. The lift-side sealing member 65 is formed of an elastic material such as a sponge or nonwoven cloth.

At the left end of the lift-side supported part 63, the intermediary conveying part 64 is formed continuously with the top of the lift-side supported part 63 (one radial side of the lift-side supported part 63). The intermediary conveying part 64 is shaped like a hollow cylinder elongated in the left-right direction. The intermediary conveying part 64 has a larger diameter than the lift-side supported part 63. A coupling recess 70 is formed in the rear side of the intermediary conveying part 64. A rotary member 66 is disposed inside the intermediary conveying part 64.

The coupling recess 70 has a square U-shape in a side view that is open on the rear side. The coupling recess 70 is provided with a through-hole 71, and a first shutter 72.

The through-hole 71 is generally rectangular in a plan view and elongated in the left-right direction. The through-hole 71 penetrates the top wall of the coupling recess 70, providing communication between the interior and exterior of the intermediary conveying part 64.

The first shutter 72 has a flat plate shape that is generally rectangular in a front view and elongated in the left-right direction. The first shutter 72 is capable of sliding in the left-right direction between a closed position indicated by the dashed line in FIG. 5 for closing the through-hole 71, and an open position to the right of the closed position indicated by the solid line in FIG. 5 for opening the through-hole 71.

The rotary member 66 includes a rotational shaft 67, a rotary member drive gear 69, and a film member 68.

The rotational shaft 67 has a general columnar shape, with its axis aligned with the central axis of the intermediary conveying part 64. The right end of the rotational shaft 67 is rotatably supported in the right wall of the intermediary conveying part 64. The left end of the rotational shaft 67 is rotatably supported in the left wall of the intermediary conveying part 64 and penetrates the left wall to the left side thereof.

The rotary member drive gear 69 is nonrotatably supported on the left end of the rotational shaft 67 on the left side of the left wall constituting the intermediary conveying part 64.

The film member 68 is provided inside the intermediary conveying part 64, extending radially outward from the outer peripheral surface of the rotational shaft 67. The film member 68 is formed of a flexible film that is flat and generally rectangular in shape.

The lift 62 is supported on the transfer frame 31 by fitting the lift-side supported part 63 into the support part 37 of the transfer frame 31 from the left side thereof. At this time, a slight gap is formed between the right side of the lift-side supported part 63 and the opposing left side of the cleaner-side supported part 52. Further, the lift-side sealing member 65 is in contact with the left end portion of the support-part-side sealing member 30 constituting the transfer frame 31 to the left of the cleaner-side sealing member 53. The lift-side sealing member 65 is almost completely compressed in its thickness direction (i.e., the radial direction of the cleaner-side supported part 52) at this time so that it would be nearly impossible to compress the lift-side sealing member 65 further.

Hence, the lift 62 is capable of rotating relative to the transfer frame 31, but is incapable of moving in a radial direction (including the front-rear direction) relative to the transfer frame 31. With this construction, the lift 62 can rotate about the central axis of the lift-side supported part 63 between a coupled position (see FIG. 4A) in which the intermediary conveying part 64 is positioned above the lift-side supported part 63, and an uncoupled position (see FIG. 4B) in which the intermediary conveying part 64 is positioned forward of the lift-side supported part 63.

The first screw 61 is a right-handed auger screw formed of a flexible resin or the like. The first screw 61 extends in the left-right direction along the central axis of the lift-side supported part 63 and is inserted through both the lift-side supported part 63 and the recovery chamber 49 of the belt cleaner 32. The right end portion of the rotational shaft constituting the first screw 61 is rotatably supported in the right side wall 46 of the belt cleaner 32, and the left end of the rotational shaft penetrates the left wall of the lift-side supported part 63 and is rotatably supported therein.

The first screw 61 also includes a screw drive gear 73, and a film member 74.

The screw drive gear 73 is nonrotatably supported on the left end portion of the rotational shaft constituting the first screw 61 on the left side of the left wall constituting the lift-side supported part 63. The screw drive gear 73 is engaged with the rotary member drive gear 69.

The film member 74 is disposed inside the lift-side supported part 63 and extends radially outward from the outer peripheral surface of the rotational shaft constituting the first screw 61. The film member 74 is formed of a flexible film that is flat and generally rectangular in shape.

3. Detailed Structure of the Process Unit (1) Process Frame

Figure 6A:
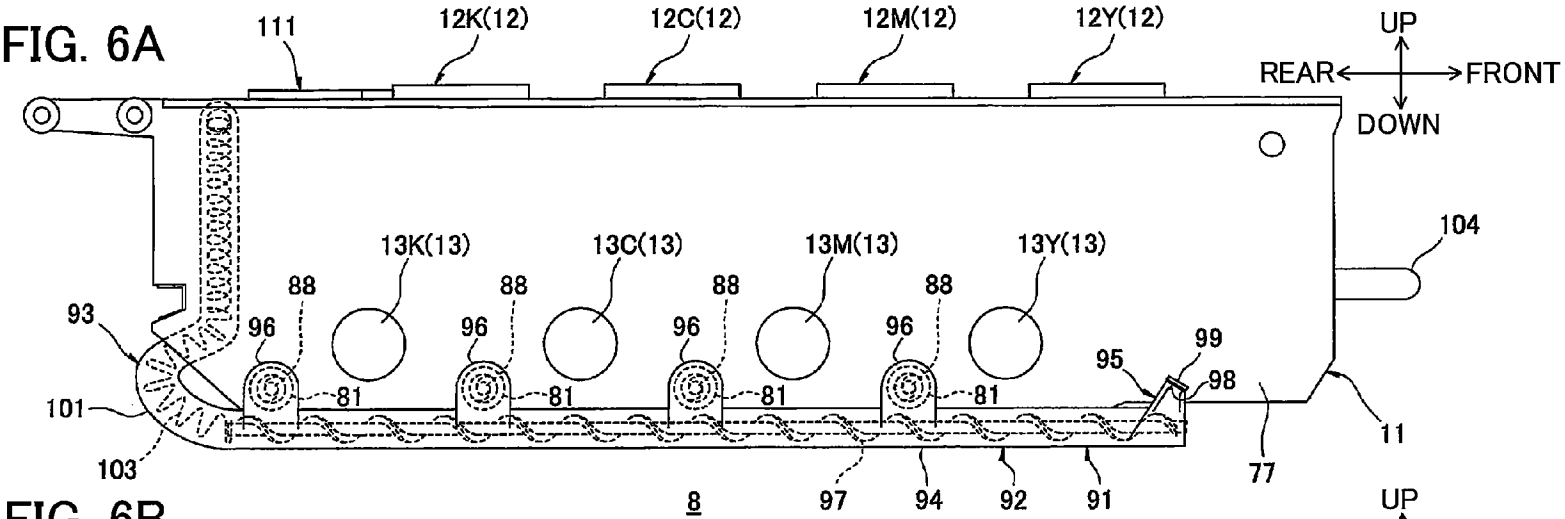
FIG. 6A is a side view of a process unit shown in FIG. 1.
Figure 6B:
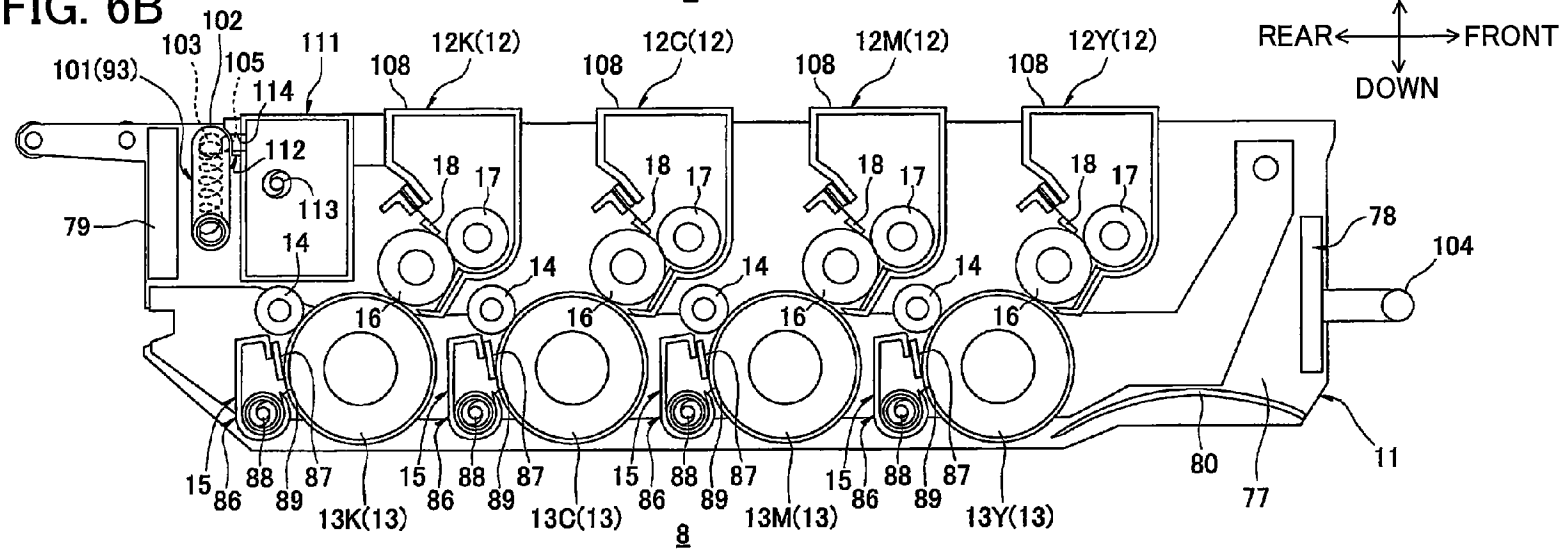
FIG. 6B is a vertical cross-sectional view of the process unit shown in FIG. 1.
Figure 7:
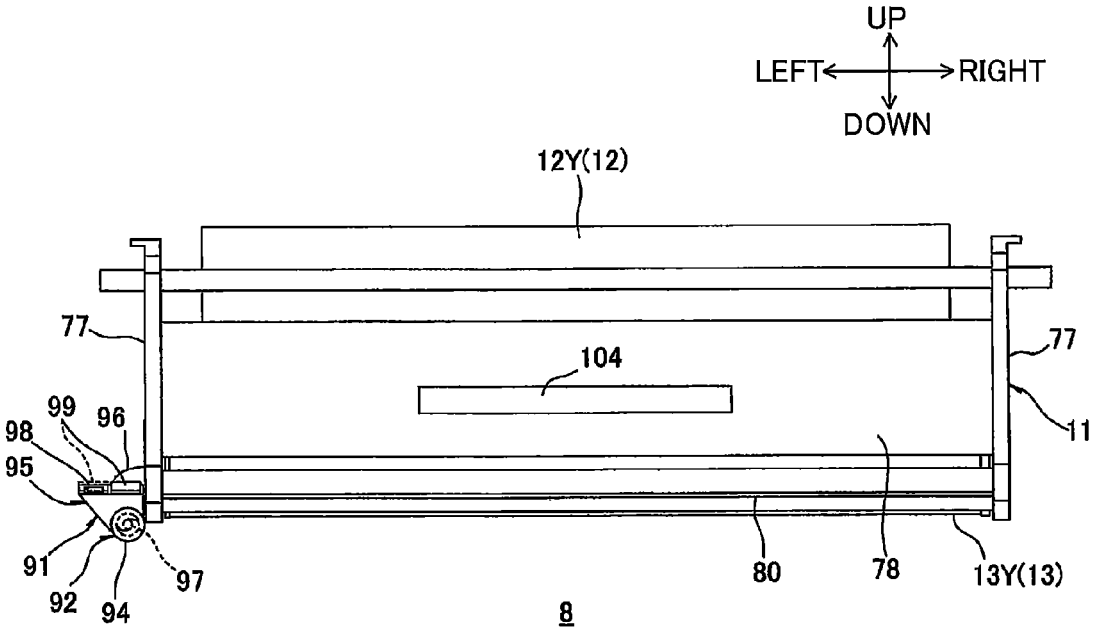
FIG. 7 is a front view of the process unit shown in FIG. 1.

As shown in FIGS. 6 and 7, the process frame 11 has a frame-like structure that is generally rectangular in a plan view. The process frame 11 includes a pair of side walls 77, a front beam 78, a rear beam 79, and a paper guide 80.

The side walls 77 are generally rectangular in a side view and elongated in the front-rear direction. The side walls 77 are arranged parallel to each other and are separated in the left-right direction. As described above, the photosensitive drums 13, charging rollers 14, and drum cleaning units 15 are supported between the side walls 77.

Each of the drum cleaning units 15 includes a drum cleaner frame 86, a drum-cleaning blade 87, and a drum cleaner screw 88.

The drum cleaner frame 86 is disposed on the rear side of the corresponding photosensitive drum 13. The drum cleaner frame 86 has a square cylindrical shape with a generally rectangular cross section. Each of the drum cleaner frames 86 is elongated in the left-right direction and bridges the side walls 77. An opening 89 is formed in the drum cleaner frame 86.

The opening 89 penetrates the front wall of the drum cleaner frame 86 in approximately the vertical center thereof and spans across the drum cleaner frame 86 in the left-right direction.

The drum-cleaning blade 87 is provided on the front side of the upper portion of the drum cleaner frame 86. The drum-cleaning blade 87 has a general flat plate shape that is elongated in the left-right direction and has substantial thickness in the front-rear direction. The upper half of the drum-cleaning blade 87 is fixed to the portion of the drum cleaner frame 86 constituting the upper peripheral edge of the opening 89. The lower half of the drum-cleaning blade 87 faces the upper half of the opening 89 formed in the drum cleaner frame 86. The bottom edge of the drum-cleaning blade 87 contacts the rear side of the corresponding photosensitive drum 13.

The drum cleaner screw 88 is disposed in the bottom end of the corresponding drum cleaner frame 86. The drum cleaner screw 88 is a right-handed auger screw that is oriented in the left-right direction. The right end portion of the rotational shaft constituting the drum cleaner screw 88 is rotatably supported in the right side wall 77 constituting the process frame 11. The left end of the rotational shaft is inserted through a screw insertion hole 81 (described later) formed in the left side wall 77 of the process frame 11 and is positioned within a drum cleaner connecting part 96 of a second conveying unit 91 described below.

The left side wall 77 is provided with four screw insertion holes 81, and the second conveying unit 91. Together with the first conveying unit 33, the second conveying unit 91 constitutes the conveying unit of the invention.

The screw insertion holes 81 are formed in the lower portion of the left side wall 77 at intervals in the front-rear direction. The positions of the screw insertion holes 81 correspond to the four drum cleaning units 15. The screw insertion holes 81 are generally circular in a side view and have a slightly larger diameter than the outer diameter of the drum cleaner screws 88.

The second conveying unit 91 includes a horizontal conveying unit 92, and a curved conveying unit 93.

The horizontal conveying unit 92 further includes a horizontal part 94, a first coupling part 95, four drum cleaner connecting parts 96, and a second screw 97.

The horizontal part 94 is generally cylindrical in shape and extends in the front-rear direction. The front end of the horizontal part 94 extends farther forward than the yellow photosensitive drum 13Y, while the rear end extends farther rearward than the black photosensitive drum 13K. Further, the bottom edge of the horizontal part 94 is positioned lower than the bottom edge of the process frame 11.

The first coupling part 95 is formed continuously from the front end of the horizontal part 94 and protrudes upward therefrom. The first coupling part 95 has a generally square cylindrical shape extending vertically, with the front-rear dimension growing shorter and the left-right dimension growing longer from bottom to top. The first coupling part 95 is provided with a through-hole 98, and a second shutter 99.

The through-hole 98 is generally rectangular in a front view and elongated in the left-right direction. The through-hole 98 penetrates the top of the first coupling part 95 on the front end thereof and across the left half of the front end so as to provide communication between the interior and exterior of the horizontal part 94.

The second shutter 99 is formed in a flat plate shape that is generally rectangular in a plan view and elongated in the left-right direction. The second shutter 99 can slide in the left-right direction between a closed position (indicated by the dashed line in FIG. 7) for closing the through-hole 98, and an open position (indicated by the solid line in FIG. 7) to the right of the closed position for opening the through-hole 98.

The drum cleaner connecting parts 96 are spaced apart at intervals in the front-rear direction and are positioned to correspond to the drum cleaning units 15. Each drum cleaner connecting part 96 is generally cylindrical in shape. The drum cleaner connecting part 96 extends leftward from the peripheral edge of the corresponding screw insertion hole 81 and curves downward from right to left. The lower end of the drum cleaner connecting part 96 is in communication with the top end of the horizontal part 94.

The second screw 97 is a right-handed auger screw elongated in the front-rear direction along the central axis of the horizontal part 94. The front end portion of the rotational shaft constituting the second screw 97 is rotatably supported in the front wall of the first coupling part 95.

The curved conveying unit 93 includes a curved section 101, and a third screw 103.

The curved section 101 has a general cylindrical shape and is formed of a flexible hose or the like that can be curved. The curved section 101 is formed continuously from the rear end portion of the horizontal part 94 and curves while extending toward the upper right between the rear ends of the side walls 77 constituting the process frame 11. A through-hole 105 is formed in the front side of the upper right end of the curved section 101 to provide communication between the interior and exterior of the curved section 101. The upper right end of the curved section 101 constitutes a second coupling part 102.

The third screw 103 is a quasi-helical-shaped screw disposed in the curved section 101 and is formed continuously with the rear end of the second screw 97. The third screw 103 extends along the curved section 101 to a point near the second coupling part 102.

The front beam 78 bridges the front edges of the side walls 77. The front beam 78 has a generally flat plate shape that is elongated in the left-right direction and has substantial thickness in the front-rear direction. A grip part 104 is provided on the front surface of the front beam 78. The user grips the grip part 104 when mounting the process frame 11 in or removing the process frame 11 from the main casing 2.

The rear beam 79 bridges the rear edges of the side walls 77. The rear beam 79 has a generally flat plate shape that is elongated in the left-right direction and has substantial thickness in the front-rear direction.

The paper guide 80 is disposed in the lower front portion of the process frame 11 and is positioned below and forward of the yellow developer cartridge 12Y. The paper guide 80 has a general flat plate shape that extends in the front-rear direction while curving so that its front-rear center portion protrudes upward. The front edge of the paper guide 80 is positioned below the front beam 78 so that the paper guide 80 can receive sheets P conveyed from the paper tray 6. The rear end of the paper guide 80 is disposed below the front end of the yellow photosensitive drum 13Y, extending toward the position between the endless conveying belt 21 and yellow photosensitive drum 13Y.

(2) Developer Cartridges

As shown in FIG. 6, each developer cartridge 12 is provided with a developer frame 108.

The developer frame 108 has a box-like shape that is elongated in the left-right direction. As described above, the developing roller 16, supply roller 17, and thickness-regulating blade 18 are supported in the bottom portion of the developer frame 108, while the upper portion serves to accommodate toner.

The black developer cartridge 12K is further provided with an accommodating section 111.

The accommodating section 111 is integrally provided on the rear side of the developer frame 108 and has a box-like shape that is elongated in the left-right direction. The accommodating section 111 includes an accommodating-section-side intermediary part 112, and an accommodating section screw 113.

The accommodating-section-side intermediary part 112 is provided on the rear side of the accommodating section 111 in the upper right portion thereof. The accommodating-section-side intermediary part 112 has a generally square columnar shape and protrudes rearward from the accommodating section 111. A receiving hole 114 is formed in the accommodating-section-side intermediary part 112.

The receiving hole 114 penetrates the accommodating-section-side intermediary part 112 and the rear wall of the accommodating section 111 in the front-rear direction to provide communication between the interior and exterior of the accommodating section 111. With this construction, the accommodating section 111 and second coupling part 102 of the second conveying unit 91 are coupled so that the receiving hole 114 of the accommodating-section-side intermediary part 112 opposes the through-hole 105 of the second coupling part 102.

The accommodating section screw 113 is provided in the upper rear portion of the accommodating section 111. The accommodating section screw 113 is a right-handed auger screw that is oriented in the left-right direction. Both ends of the rotational shaft constituting the accommodating section screw 113 are rotatably supported in the side walls of the accommodating section 111.

(3) Mounted State of the Process Unit in the Main Casing

FIG. 1 shows the process unit 8 disposed in its internal position. In this state, the process unit 8 is disposed above the transfer unit 9 so that all photosensitive drums 13 are in contact with the top portion of the endless conveying belt 21.

At this time, the bottom of the horizontal part 94 is positioned lower than the top portion of the endless conveying belt 21. Further, the paper guide 80 of the process unit 8 is positioned above the belt cleaner 32 of the transfer unit 9 and is separated from the top of the belt cleaner 32. The space formed between the paper guide 80 and the top wall 48 of the belt cleaner 32 functions as a portion of the path through which the sheets P pass.

Further, the first shutter 72 of the first conveying unit 33 is disposed in the open position indicated by the solid line in FIG. 5 for exposing the through-hole 71, and the second shutter 99 of the second conveying unit 91 is disposed in the open position indicated by the solid line in FIG. 7 for exposing the through-hole 98.

Figure 8:
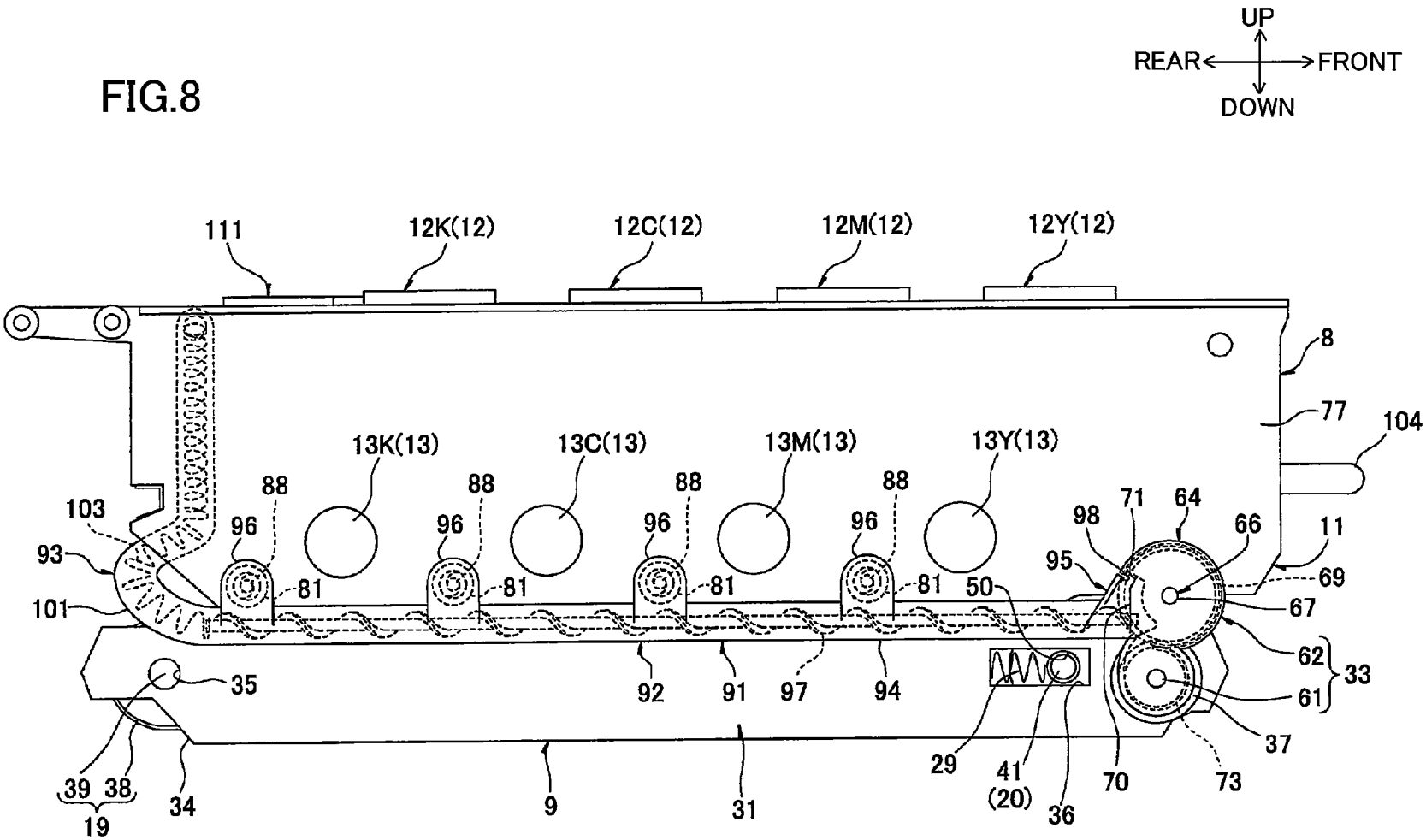
FIG. 8 is an explanatory diagram showing a coupling with a first conveying unit and a second conveying unit.

As shown in FIG. 8, the first conveying unit 33 is disposed in the coupled position (see FIG. 4A) in which the intermediary conveying part 64 is positioned above the lift-side supported part 63. In this position, the coupling recess 70 is coupled with the first coupling part 95 of the second conveying unit 91 from the front side thereof. Consequently, the through-hole 71 in the first conveying unit 33 is in communication with the through-hole 98 of the second conveying unit 91.

4. Operations for Recovering Matter Deposited on the Conveying Belt and Photosensitive Drums Prior to executing the image-forming operation described earlier, the printer 1 directly transfers toner onto the surface of the endless conveying belt 21 to form a printed pattern (patches). As the endless conveying belt 21 circulates, bringing the printed pattern opposite the patch sensor 27 on the lower side of the transfer unit 9, the patch sensor 27 reads the printed pattern and measures positional offset and image density for each printed color.

As the endless conveying belt 21 continues to circulate, the printed pattern passes through the area in which the cleaning blade 45 contacts the endless conveying belt 21. The cleaning blade 45 scrapes off residual toner, paper dust, and other matter deposited on the endless conveying belt 21 and the matter is collected in the recovery chamber 49 of the cleaner frame 44. Since the belt cleaner 32 is configured to move in the front-rear direction together with the follow roller 20, the belt cleaner 32 can reliably recover (remove) residual toner and other matter from the endless conveying belt 21. This completes the operation for measuring the positional offset and image density of each printed color.

Next, as described earlier, the sheet-feeding unit 3 feeds a sheet P toward the image-forming unit 4. The endless conveying belt 21 conveys the sheet P rearward so that the sheet P sequentially passes between each photosensitive drum 13 and opposing transfer roller 22 while an image is formed on the sheet P.

After completing this image-forming operation and prior to executing the next image-forming operation, the printer 1 recovers residual toner and other matter deposited on the photosensitive drums 13. As shown in FIG. 6, the drum-cleaning blades 87 contacting the rear sides of the corresponding photosensitive drums 13 scrape off residual toner and other matter deposited on the photosensitive drums 13, and the matter is collected in the corresponding drum cleaner frames 86. Through this process, the printer 1 can remove and collect residual toner and other matter that has become deposited on the endless conveying belt 21 and the photosensitive drums 13.

Next, the first screw 61 in the recovery chamber 49 of the cleaner frame 44 rotates clockwise in a left side view to convey the residual toner and other deposited matter collected in the recovery chamber 49 leftward toward the left end of the cleaner frame 44 shown in FIG. 5. The first screw 61 conveys the residual toner through the cleaner-side supported part 52 and support part 37 into the lift-side supported part 63.

Since the first screw 61 is formed of a flexible resin or the like, the first screw 61 is reliably supported in the right side wall 46 of the belt cleaner 32 and the left wall of the lift-side supported part 63, even if the belt cleaner 32 and first conveying unit 33 move in the front-rear direction. As the first screw 61 rotates, residual toner and other matter conveyed to the lift-side supported part 63 is subsequently pushed out of the lift-side supported part 63 into the intermediary conveying part 64 shown in FIG. 4A. Next, the rotating rotary member 66 causes the film member 68 to push the residual toner in the intermediary conveying part 64 out of the intermediary conveying part 64 through the through-hole 71 and into the first coupling part 95 through the through-hole 98, thereby conveying the residual toner to the horizontal part 94 of the horizontal conveying unit 92 (see FIG. 8).

At the same time, the drum cleaner screws 88 in the drum cleaner frames 86 rotate clockwise in a left side view to convey residual toner and other deposited matter stored in the drum cleaner frames 86 toward the left ends of the drum cleaner frames 86. As illustrated in FIG. 6, the residual toner and other deposited matter conveyed by the drum cleaner screws 88 pass through the screw insertion holes 81 formed in the left side wall 77 of the process frame 11 and is conveyed to the horizontal part 94 of the horizontal conveying unit 92 via the drum cleaner connecting parts 96.

In this way, residual toner and other deposited matter recovered from the endless conveying belt 21 and photosensitive drums 13 are conveyed to the horizontal part 94 of the horizontal conveying unit 92. Subsequently, the rotating second screw 97 conveys this residual toner through the horizontal part 94 to the curved conveying unit 93. When deposited matter has been conveyed to the curved conveying unit 93, the rotating third screw 103 conveys this matter through the curved section 101 to a point near the second coupling part 102, and matter accumulated at the second coupling part 102 falls through the second coupling part 102 and accommodating-section-side intermediary part 112 into the accommodating section 111. In this way, residual toner and other deposited matter collected from the endless conveying belt 21 and photosensitive drums 13 are stored in the accommodating section 111.

5. Operations for Replacing a Developer Cartridge

To replace one of the developer cartridges 12, first the user pulls the process unit 8 out to the external position. To pull the process unit 8 out to the external position, the user opens the front cover 5 of the main casing 2 by rotating the front cover 5 forward and downward about its bottom edge, as shown in FIG. 9.

Next, the user moves the first shutter 72 of the first conveying unit 33 into the closed position indicated by the dashed line in FIG. 5 for closing the through-hole 71 and moves the second shutter 99 of the second conveying unit 91 into the closed position indicated by the dashed line in FIG. 7 for closing the through-hole 98. These operations interrupt communication between the through-hole 71 of the first conveying unit 33 and the through-hole 98 of the second conveying unit 91. Next, the user rotates the first conveying unit 33 about the central axis of the lift-side supported part 63 into the uncoupled position shown in FIG. 4B. This operation separates the coupling recess 70 from the first coupling part 95. Next, the user grips the grip part 104 and pulls the process unit 8 forward, thereby separating the photosensitive drums 13 from the endless conveying belt 21 and moving the process unit 8 into the external position.

Next, the user removes the developer cartridge 12 to be replaced from the process unit 8. To remove from the developer cartridge 12, the user pulls the developer cartridge 12 upward from the process unit 8.

When removing the black developer cartridge 12K, the receiving hole 114 moves upward relative to the through-hole 105, separating the accommodating-section-side intermediary part 112 of the accommodating section 111 from the second coupling part 102 of the second conveying unit 91. Through this operation, the accommodating section 111 provided integrally with the black developer cartridge 12K is separated from the process unit 8, enabling the user to perform maintenance on the accommodating section 111.

To mount a developer cartridge 12 into the process unit 8, the user performs the operation described above in reverse. Specifically, the user positions the developer cartridge 12 above the process unit 8 and pushes the developer cartridge 12 into the process unit 8.

When mounting a black developer cartridge 12K into the process unit 8, the receiving hole 114 moves to a position opposite the through-hole 105, allowing for communication between the second coupling part 102 of the second conveying unit 91 and the accommodating-section-side intermediary part 112 of the accommodating section 111.

Next, the user grips the grip part 104 and pushes the process unit 8 rearward into the main casing 2. Subsequently, the user rotates the first conveying unit 33 about the central axis of the lift-side supported part 63 into the coupled position shown in FIG. 4A. Through this operation, the coupling recess 70 is coupled with the first coupling part 95.

Next, the user moves the first shutter 72 of the first conveying unit 33 into the open position indicated by the solid line in FIG. 5 for exposing the through-hole 71 and moves the second shutter 99 of the second conveying unit 91 into the open position indicated by the solid line in FIG. 7 for exposing the through-hole 98. Through these operations, the through-hole 71 of the first conveying unit 33 is in communication with the through-hole 98 of the second conveying unit 91.

Thereafter, the user closes the front cover 5 of the main casing 2, thereby completing the operation for replacing a developer cartridge 12.

6. Operational Advantages (1) As shown in FIG. 3A, the position of the cleaning blade 45 is fixed relative to the endless conveying belt 21 in the printer 1 according to the embodiment. Accordingly, deposited matter removed from the endless conveying belt 21 by the cleaning blade 45 is unlikely to detach from the cleaning blade 45 when the process frame 11 is moved. Thus, the cleaning blade 45 can reliably collect residual matter from the endless conveying belt 21.

Further, the second conveying unit 91 responsible for conveying deposited matter received from the first conveying unit 33 is retained on the process frame 11. Therefore, when the process frame 11 is moved, the second conveying unit 91 moves together with the process frame 11, enabling the process frame 11 to be moved smoothly.

Thus, the above configuration achieves both the reliable collection of residual matter from the endless conveying belt 21 and smooth operation of the process frame 11.

(2) As shown in FIG. 9, the accommodating section 111 is integrally provided with the black developer cartridge 12K in the printer 1 according to the embodiment. Accordingly, maintenance can be performed on the accommodating section 111 at the same time maintenance is being performed on the black developer cartridge 12K. This configuration is more efficient for maintaining the accommodating section 111 than when the black developer cartridge 12K and accommodating section 111 are serviced separately.

(3) As shown in FIG. 9, the second conveying unit 91 can be separated from the lift 62 of the first conveying unit 33 at the first coupling part 95 when the process unit 8 is moved from the internal position to the external position, as shown in FIG. 9. Consequently, the process unit 8 can move smoother being separated from the first conveying unit 33.

Further, the second conveying unit 91 can be separated from the accommodating section 111 at the second coupling part 102 when performing maintenance on the accommodating section 111. The accommodating section 111 can be serviced easier while separated from the second conveying unit 91.

(4) As shown in FIG. 2, the printer 1 also has the first screw 61, which can convey deposited matter removed by the cleaning blade 45 leftward to concentrate the matter on the left side.

(5) As shown in FIG. 8, the second conveying unit 91 of the printer 1 is retained on the left side wall 77 of the process frame 11. Accordingly, deposited matter accumulated on the left side by the first screw 61 can easily be conveyed into the second conveying unit 91.

Further, since the second conveying unit 91 is provided along the left side wall 77 of the process frame 11, the second conveying unit 91 does not interfere with the process unit 8 when the process unit 8 is moved, allowing for smooth operations of the process unit 8.

(6) As shown in FIG. 8, the lift 62 provided in the first conveying unit 33 conveys deposited matter received from the first screw 61 to the second conveying unit 91. With this configuration, the lift 62 can reliably convey deposited matter received from the first screw 61 to the second conveying unit 91.

(7) When the process unit 8 is pulled out of the printer 1 according to the embodiment, as shown in FIG. 9, the lift 62 of the first conveying unit 33 separates from the second conveying unit 91 at the coupling recess 70. Further, as the coupling recess 70 is uncoupled from the second conveying unit 91 when the process unit 8 is moved, the through-hole 71 of the coupling recess 70 can be closed with the first shutter 72. This construction allows the process unit 8 to be moved while preventing the matter recovered in the first conveying unit 33 from leaking out through the through-hole 71 formed in the coupling recess 70. Thus, this configuration achieves both functions of reliably recovering matter deposited on the endless conveying belt 21 and enabling smooth movement of the process unit 8.

(8) As illustrated in FIG. 1, the bottom end of the first coupling part 95 constituting the second conveying unit 91 is disposed lower than the top portion of the endless conveying belt 21. Providing the first coupling part 95 lower than the upper portion of the endless conveying belt 21 allows for a shorter conveying path for conveying deposited matter from the cleaning blade 45 to the second conveying unit 91 than if the first coupling part 95 were disposed higher than the endless conveying belt 21. This configuration prevents the first conveying unit 33 (and specifically the lift 62) from protruding into the path of the process unit 8.

Consequently, the simple construction of the rotating lift 62 easily prevents the first conveying unit 33 from interfering with the process unit 8 as the process unit 8 is removed from and mounted in the main casing 2, thereby achieving smooth operations of the process unit 8.

Further, this construction can more reliably convey deposited matter removed by the cleaning blade 45 to the second conveying unit 91.

(9) As shown in FIGS. 1 and 9, the process unit 8 is moved in a forward from the internal position (FIG. 1) to the external position (FIG. 9). Accordingly, the user can access the process unit 8 from the front side of the printer 1 and can easily move the process unit 8 along the front-rear direction, even when the installation location of the printer 1 provides limited space above the printer 1 and on left and right sides thereof.

(10) As shown in FIG. 8, the second conveying unit 91 is used to convey deposited matter removed by the drum cleaning units 15 to the accommodating section 111. Therefore, this construction does not require a separate member for conveying deposited matter removed by the drum cleaning units 15, allowing the surfaces of the photosensitive drums 13 to be cleaned through a simple configuration.

6. Second Embodiment

Next, a second embodiment of the present invention will be described with reference to FIGS. 10 and 11, wherein like parts and components are designated with the same reference numerals to avoid duplicating description.

In the first embodiment described above, the photosensitive drums 13 are exposed by the scanning unit 7, and the process unit 8 is configured to slide in the front-rear direction. However, in the second embodiment illustrated in FIGS. 10 and 11, the photosensitive drums 13 are exposed by individual LED units 121, and the process unit 8 is configured to slide vertically.

(1) Structure of the Printer in the Second Embodiment

Figure 10:
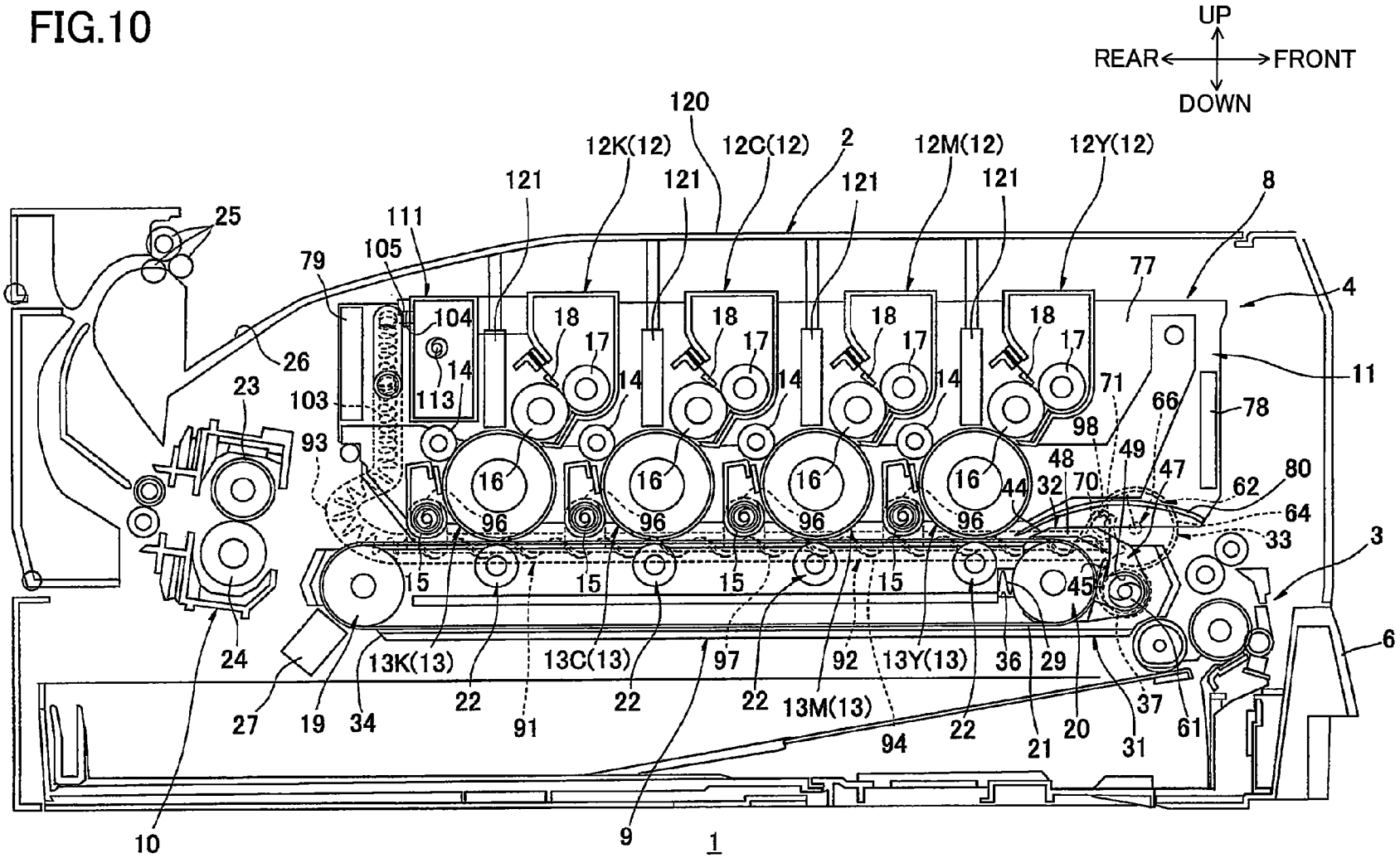
FIG. 10 is a vertical cross-sectional view of an image-forming device according to a second embodiment of the present invention.

As shown in FIG. 10, the main casing 2 in the second embodiment is provided with a top cover 120 in place of the front cover 5. The top cover 120 is disposed on the top of the main casing 2 and is capable of pivoting about its rear edge. Each of the LED units 121 is positioned between a developing roller 16 and corresponding charging roller 14 and above the corresponding photosensitive drum 13, and is slightly separated from the top of the photosensitive drum 13. The LED units 121 are generally rectangular in a side view and elongated vertically. The top end of each LED unit 121 is retained on the bottom surface of the top cover 120. An LED array (not shown) having a plurality of LEDs is supported on the bottom end of the LED unit 121.

(2) Mounting and Removing the Process Unit in the Second Embodiment

Figure 11:
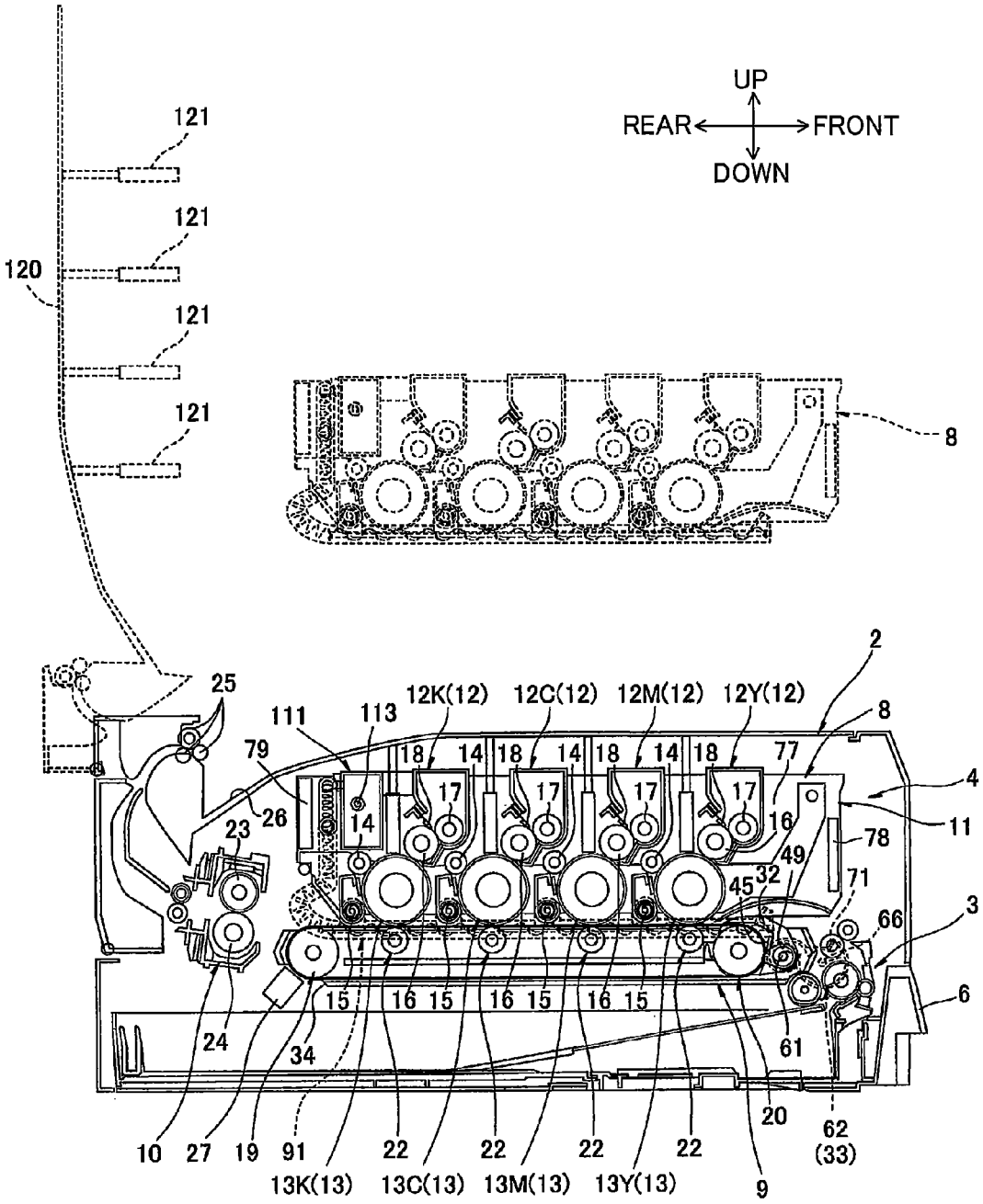
FIG. 11 is an explanatory diagram showing a state a process unit shown in FIG. 10 is disposed in an external position.

To remove the process unit 8 from the main casing 2 in the second embodiment, the user opens the top cover 120 to the position shown in FIG. 11. After placing the lift 62 in the uncoupled position, the user lifts the process unit 8 upward and out of the main casing 2. The process unit 8 is disposed in the external position (indicated by dashed lines in FIG. 11) when separated from the main casing 2.

To mount the process unit 8 in the main casing 2, the user opens the top cover 120 and places the process unit 8 in its internal position inside the main casing 2. Subsequently, the user places the lift 62 in the coupled position and closes the top cover 120.

(3) Operational Advantages of the Second Embodiment

The printer 1 according to the second embodiment achieves the same operational advantages described in the first embodiment.

7. Third Embodiment

Figure 12:
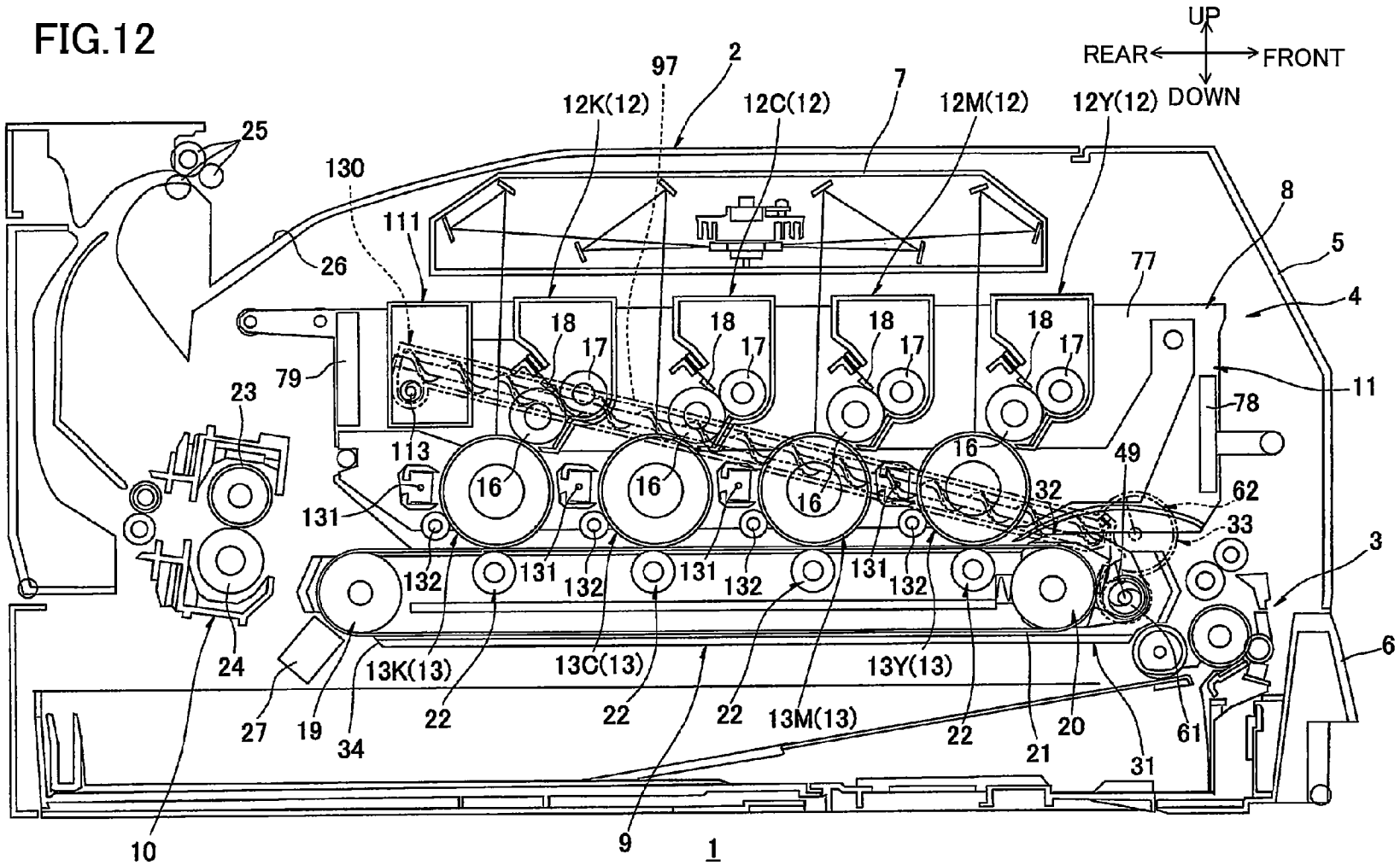
FIG. 12 is a vertical cross-sectional view of an image-forming device according to a third embodiment of the present invention.

Next, a third embodiment of the present invention will be described with reference to FIGS. 12 and 13, wherein like parts and components are designated with the same reference numerals to avoid duplicating description.

In the first embodiment described above, the second conveying unit 91 is configured of the horizontal conveying unit 92 and curved conveying unit 93. Deposited matter recovered by the belt cleaner 32 is first conveyed rearward through the horizontal conveying unit 92 and is subsequently conveyed to the accommodating section 111 through the curved conveying unit 93 while passing around the rear edge of the left side wall 77 constituting the process frame 11.

However, the printer 1 according to the third embodiment has a second conveying unit 130 that slopes upward toward the rear. Accordingly, the second conveying unit 130 conveys deposited matter recovered by the belt cleaner 32 diagonally upward and rearward toward the accommodating section 111.

(1) Structure of the Printer in the Third Embodiment

In the third embodiment, the process unit 8 is provided with scorotron chargers 131 in place of the charging rollers 14, and drum cleaning rollers 132 in place of the drum cleaning units 15.

The scorotron chargers 131 are positioned to confront the rear sides of corresponding photosensitive drums 13, with a gap formed therebetween.

The drum cleaning rollers 132 are positioned below corresponding scorotron chargers 131 and contact the corresponding photosensitive drums 13 on the lower rear sides thereof. A prescribed drum cleaning bias is applied to the drum cleaning rollers 132. After toner images have been transferred from the photosensitive drums 13 onto the sheet P in the image-forming operation described above, residual toner particles and paper dust on the peripheral surfaces of the photosensitive drums 13 are electrostatically attracted to the outer peripheral surfaces of the drum cleaning rollers 132 and temporarily retained thereon.

Figure 13:
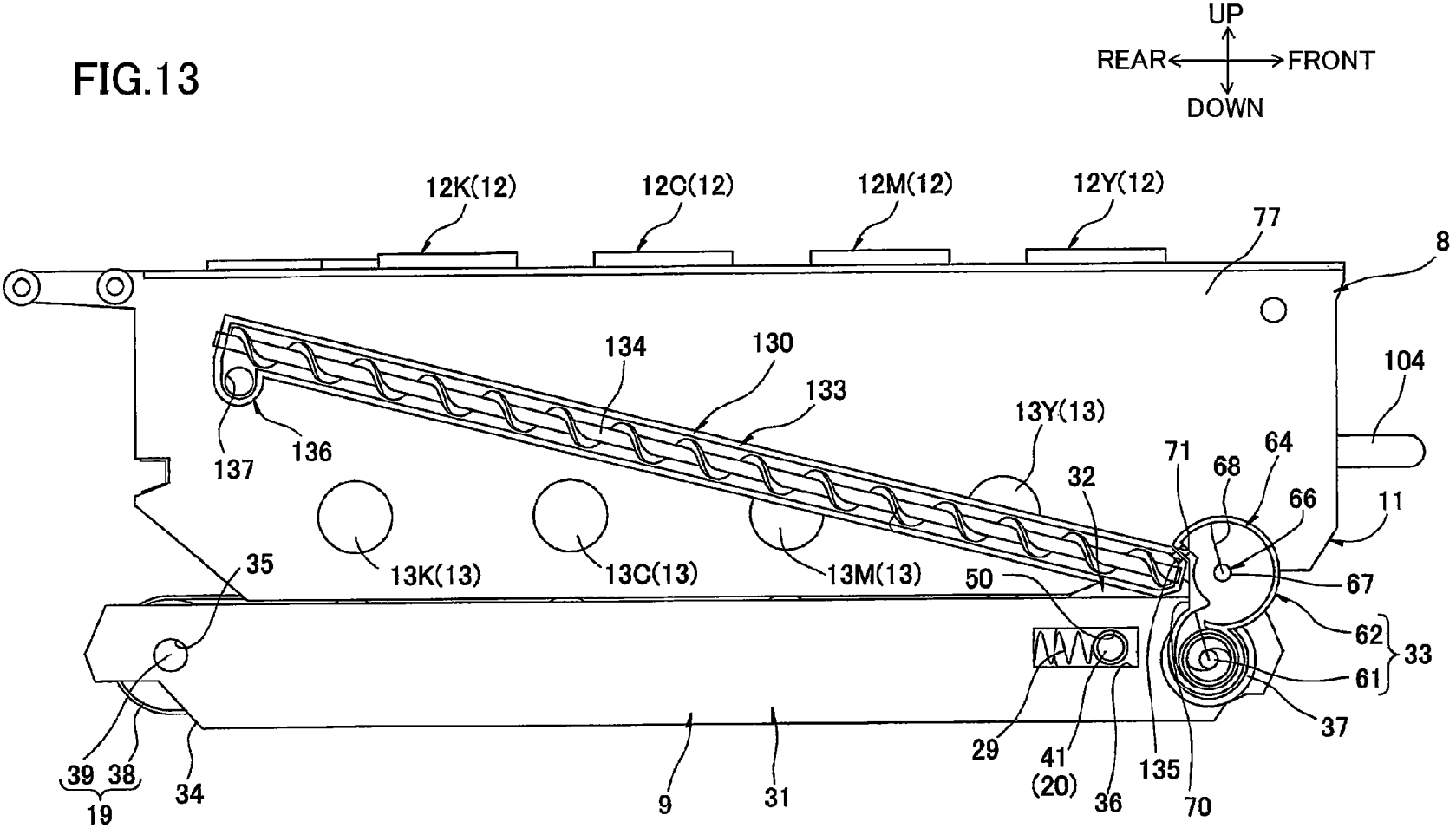
FIG. 13 is an explanatory diagram showing a coupling with a first conveying unit and a second conveying unit.

As shown in FIG. 13, the second conveying unit 130 includes a conveying tube 133, and a second screw 134.

The conveying tube 133 is fixed to the left side of the left side wall 77 constituting the process frame 11. The conveying tube 133 extends diagonally upward from the lower front side of the left side wall 77 to the upper rear side thereof, and is formed in a generally cylindrical shape that is closed on the lower front end and the upper rear end. The lower front end of the conveying tube 133 is positioned beneath the bottom edge of the process frame 11. Thus, when the process unit 8 is disposed in the internal position, the lower front end of the conveying tube 133 is positioned beneath the upper portion of the endless conveying belt 21. A through-hole 135 is also formed in the lower front end of the conveying tube 133, and a coupling part 136 is provided on the upper rear end of the conveying tube 133.

The through-hole 135 formed in the lower front end of the conveying tube 133 penetrates the top side thereof.

The coupling part 136 is formed continuously from the bottom side of the upper rear end of the conveying tube 133 and protrudes downward therefrom. The coupling part 136 has a generally U-shaped cross section and is open on the top. A supply hole 137 is formed in the coupling part 136.

The supply hole 137 is generally circular in a side view and penetrates the right wall of the coupling part 136. The supply hole 137 is in communication with the interior of the accommodating section 111 via a through-hole (not shown) formed in the left side wall 77 of the process frame 11 and a through-hole (not shown) formed in the left wall of the accommodating section 111.

The second screw 134 is a right-handed auger screw that extends within the conveying tube 133 from the lower front end to the upper rear end thereof. The lower front end of the rotational shaft constituting the second screw 134 is rotatably supported in the lower front wall of the conveying tube 133, while the upper rear end of the rotational shaft is rotatably supported in the upper rear wall of the conveying tube 133.

(2) Operations for Recovering Deposited Matter in the Third Embodiment

Next, the operations for recovering deposited matter according to the third embodiment will be described with reference to FIG. 13. During the image-forming operation in the third embodiment, a cleaning bias is applied to the drum cleaning rollers 132 for attracting matter deposited on the surfaces of the corresponding photosensitive drums 13 as the matter rotates opposite the drum cleaning rollers 132 and for temporarily retaining the matter on the peripheral surfaces of the drum cleaning rollers 132.

Once the image-forming operation is complete, a bias of reverse polarity to the drum cleaning bias is applied to the drum cleaning rollers 132, causing the deposited matter temporarily retained on the drum cleaning rollers 132 to be released back to the endless conveying belt 21 via the respective photosensitive drums 13.

The belt cleaner 32 subsequently recovers the deposited matter discharged onto the endless conveying belt 21 as the endless conveying belt 21 circulates and the matter passes along the bottom of the transfer unit 9. As in the first embodiment described earlier, deposited matter recovered by the belt cleaner 32 is conveyed leftward toward the left end of the cleaner frame 44 by the rotating first screw 61. The first screw 61 conveys the deposited matter into the lift-side supported part 63 via the cleaner-side supported part 52 and support part 37. Subsequently, the deposited matter is conveyed through the intermediary conveying part 64 to the conveying tube 133 while passing through the through-hole 71 and through-hole 135. Thereafter, the rotating second screw 134 conveys the deposited matter received in the conveying tube 133 through the conveying tube 133 from the lower front end to the upper rear end, and the deposited matter is collected in the accommodating section 111 through the supply hole 137.

(3) Operational Advantages of the Third Embodiment

The printer 1 according to the third embodiment obtains the same operational advantages described in the first embodiment.

8. Fourth Embodiment

Figure 14:
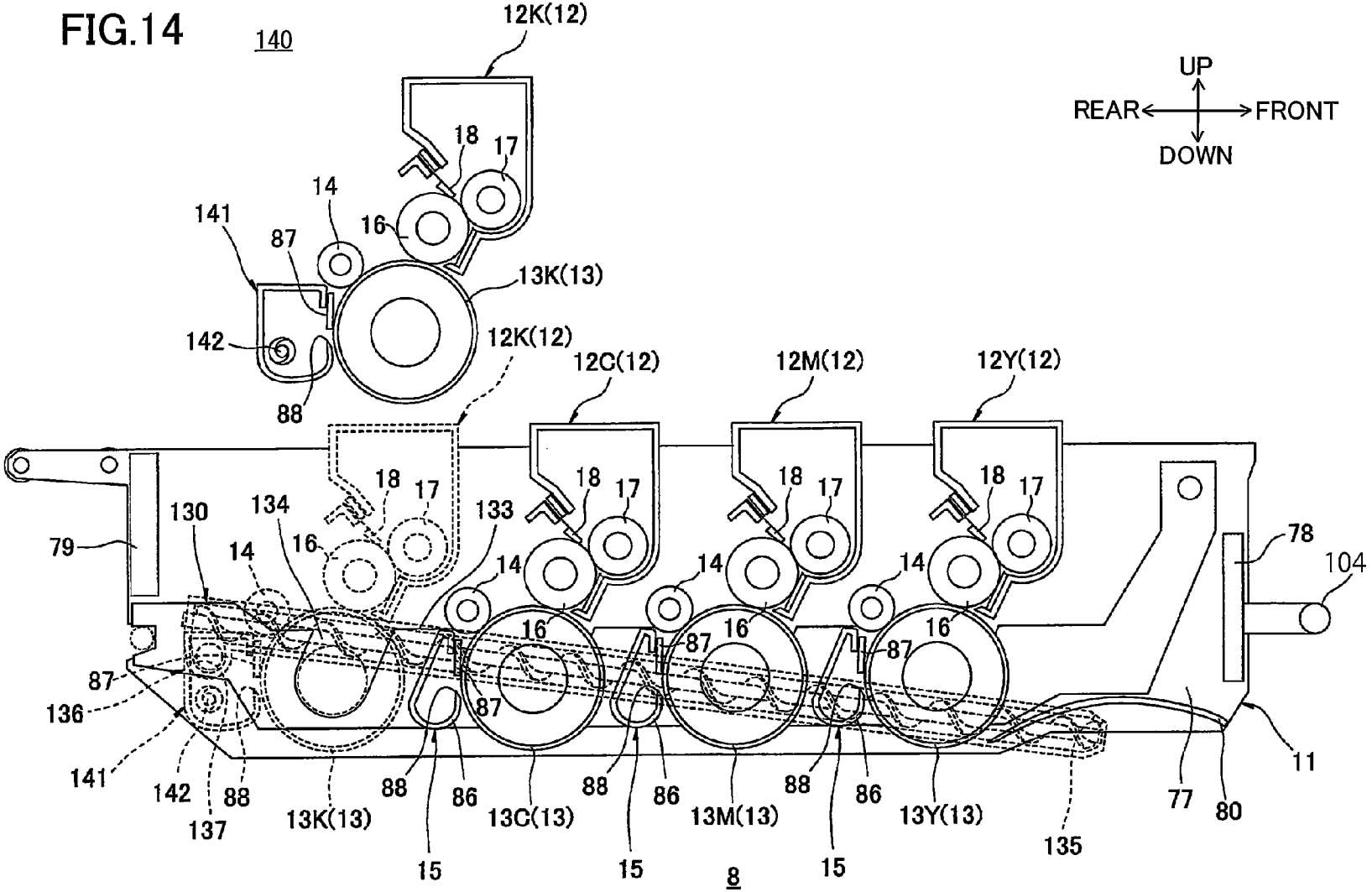
FIG. 14 is an explanatory diagram showing a process unit of an image-forming device according to a fourth embodiment of the present invention.

Next, a fourth embodiment of the present invention will be described with reference to FIG. 14, wherein like parts and components are designated with the same reference numerals to avoid duplicating description.

In the third embodiment described above, the upper rear end of the conveying tube 133 is coupled to the accommodating section 111. However, in the fourth embodiment, the upper rear end of the conveying tube 133 is coupled to a drum cleaning unit 141 corresponding to the black photosensitive drum 13K, as illustrated in FIG. 14. The drum cleaning unit 141 corresponding to the black photosensitive drum 13K has a general box-like shape and is larger than the drum cleaning units 15 corresponding to the other photosensitive drums 13.

A drum cleaner screw 142 is provided in the lower end of the drum cleaning unit 141. The drum cleaner screw 142 is a right-handed auger screw extending in the left-right direction. Both ends of the rotational shaft constituting the drum cleaner screw 142 are rotatably supported in corresponding side walls of the drum cleaning unit 141.

In the other embodiments described above, the process frame 11 is provided with the photosensitive drums 13, and the developer cartridges 12 are detachably mounted in the process frame 11. However, in the fourth embodiment, the photosensitive drum 13, charging roller 14, drum cleaning unit 141 (or drum cleaning unit 15) and developer cartridge 12 are integrally configured as a process cartridge 140. The process cartridge 140 can be detachably mounted as a unit in the process frame 11, as indicated by the dashed lines in FIG. 14.

The printer 1 according to the fourth embodiment obtains the same operational advantages described in the first embodiment.

While the invention has been described in detail with reference to the embodiments thereof, it would be apparent to those skilled in the art that various changes and modifications may be made therein without departing from the spirit of the invention.

What is claimed is:

1. An image forming device comprising:

a main body comprising:

an endless belt;

a first cleaning member configured to remove deposited matter on the endless belt; and a belt side conveying unit configured to convey the deposited matter removed by the first cleaning member; and a process unit configured to be movable between an internal position inside the main body and an external position outside the main body, the process unit comprising:

a photosensitive body on which a developer image is formable, wherein the endless belt contacts the photosensitive body when the process unit is in the internal position and is away from the photosensitive body when the process unit is in the external position;

a retaining member configured to retain the photosensitive body;

a receptacle configured to be detachably mounted in the retaining member and store the deposited matter removed by the first cleaning member; and a retaining member side conveying unit configured to convey the deposited matter conveyed by the belt side conveying unit into the receptacle.

2. The image forming device according to claim 1, wherein the photosensitive body includes a plurality of photosensitive bodies arranged in parallel to one another and spaced apart a predetermined distance between adjacent two photosensitive bodies.

3. The image forming device according to claim 2, wherein the process unit further comprises a plurality of developer accommodating members configured to be detachably mounted in the retaining member, the plurality of developer accommodating members being provided in one-to-one correspondence with the plurality of photosensitive bodies, each of the plurality of developer accommodating members being configured to supply developer onto corresponding one of the plurality of photosensitive bodies, wherein the receptacle is integrally provided with one of the plurality of developer accommodating members, the receptacle and the one of the plurality of developer accommodating members being integrally mounted in and removable from the retaining member.

4. The image forming device according to claim 3, wherein the retaining member side conveying unit has a first coupling part and a second coupling part, the first coupling part being configured to be separably coupled with the belt side conveying unit, the second coupling part being configured to be separably coupled with the receptacle.

5. The image forming device according to claim 4, wherein the first coupling part is disposed nearer to the retaining member than the endless belt.

6. The image forming device according to claim 2, wherein each of the plurality of photosensitive bodies is of an elongated shape extending in a longitudinal direction, the belt side conveying unit including a first conveying member configured to convey the deposited matter toward one longitudinal direction of the plurality of photosensitive bodies.

7. The image forming device according to claim 6, wherein the retaining member side conveying unit is provided in a position in the vicinity of one longitudinal end of one of the plurality of photosensitive bodies.

8. The image forming device according to claim 6, wherein the belt side conveying unit further includes a second conveying member configured to convey the deposited matter conveyed by the first conveying member to the retaining member side conveying unit.

9. The image forming device according to claim 8, wherein the second conveying member includes:

a coupling part configured to be separably coupled with the retaining member side conveying unit; and a shutter member configured to close the coupling part while the coupling part is decoupled from the retaining member side conveying unit.

10. The image forming device according to claim 2, wherein the retaining member is configured to be movable in a direction in which the plurality of photosensitive bodies is arranged.

11. The image forming device according to claim 2, wherein the process unit further comprises:

a plurality of second cleaning members provided in one-to-one correspondence with the plurality of photosensitive bodies, each of the plurality of second cleaning members being configured to remove deposited matter on a surface of corresponding one of the plurality of photosensitive bodies; and a plurality of conveying parts provided in one-to-one correspondence with the plurality of second cleaning members, each of the plurality of conveying parts conveying the deposited matter removed by corresponding one of the plurality of second cleaning members to the retaining member side conveying unit.

* * * * *